US007661226B2

(12) United States Patent
Kibbel et al.

(10) Patent No.: US 7,661,226 B2
(45) Date of Patent: Feb. 16, 2010

(54) INSTALLATION METHOD FOR A STORM DOOR

(75) Inventors: Keith Kibbel, Forest Lake, MN (US); Michael D. Gonnerman, Lakeville, MN (US); Rashid Bharucha, Roseville, MN (US); Mark E. Abdella, St. Paul, MN (US); Duane Pecinovsky, Clear Lake, IA (US); John M. Parkhurst, Minnetonka, MN (US); Gary L. Spoelstra, Pella, IA (US); Todd N. Stratmoen, Mahtomedi, MN (US); José Carlos Figueiredo da Cunha, Dão (PT)

(73) Assignee: Larson Manufacturing Company, Brookings, SD (US)

( * ) Notice: Subject to any disclaimer, the term of this patent is extended or adjusted under 35 U.S.C. 154(b) by 506 days.

(21) Appl. No.: 11/215,294

(22) Filed: Aug. 30, 2005

(65) Prior Publication Data

US 2006/0150524 A1 Jul. 13, 2006

Related U.S. Application Data

(60) Provisional application No. 60/642,847, filed on Jan. 11, 2005.

(51) Int. Cl.
*E06B 3/36* (2006.01)

(52) U.S. Cl. ..... 49/382; 49/394

(58) Field of Classification Search ..... 49/380, 49/382, 501; 292/137, 140, 143, 163, 169, 292/172, 173; 70/107–111, 462
See application file for complete search history.

(56) References Cited

U.S. PATENT DOCUMENTS 3,298,135 A * 1/1967 Kinser ..... 49/380
3,629,972 A * 12/1971 Rehberg et al. ..... 49/240
4,001,972 A 1/1977 Hurwitz
4,106,238 A * 8/1978 Bonello ..... 49/382
4,514,878 A 5/1985 Arneberg
4,709,445 A 12/1987 Waldo et al.
4,731,952 A 3/1988 Mascotte
5,152,487 A 10/1992 Defatte et al.
5,216,839 A * 6/1993 Woodruff ..... 49/382

(Continued)

*Primary Examiner*—Katherine W Mitchell
*Assistant Examiner*—Michael J Keller
(74) *Attorney, Agent, or Firm*—Faegre & Benson LLP

(57) ABSTRACT

The present invention is a system and method for an easy installation storm door for installation in a home. The door system may include a door panel that is mounted onto two vertical z-bar frames such that the door system can be installed in a left hinge or right hinge format. The z-bar frames are precut at the factory to be shorter than a standard door-frame so that they do not have to be cut during installation. Also included in the system are top and bottom expanders that fit onto a top and bottom side of the door panel so as to selectively adjust the vertical height of the door panel. The top and bottom expanders further insure a reasonable air and moisture barrier between the interior and exterior of the home. The door system further includes a lock assembly that is pre-installed such that it can be utilized whether the door system is installed in a left hinge or right hinge format. The lock system may include a lockbody that includes duplicate hardware such that the door panel can be situated in the doorframe in a right hinge or left hinge format without having to adjust the position or orientation of the lockbody.

10 Claims, 24 Drawing Sheets

U.S. PATENT DOCUMENTS

| | | | | |
|---|---|---|---|---|
| 5,327,684 | A | 7/1994 | Herbst | |
| 5,423,149 | A | 6/1995 | Herbst | |
| 5,603,194 | A * | 2/1997 | Fridlyand et al. | 52/515 |
| 5,832,670 | A * | 11/1998 | Bennett | 49/382 |
| 6,170,198 | B1 | 1/2001 | Staples et al. | |
| 6,317,922 | B1 | 11/2001 | Kondratuk | |
| 6,640,387 | B2 | 11/2003 | Alonso | |
| 6,688,063 | B1 * | 2/2004 | Lee et al. | 52/455 |
| 6,705,047 | B2 * | 3/2004 | Yulkowski | 49/346 |
| 7,117,639 | B2 * | 10/2006 | Abdella et al. | 49/382 |
| 7,354,081 | B2 * | 4/2008 | Kondratuk | 292/169 |
| 2002/0020124 | A1 * | 2/2002 | Kusano et al. | 52/213 |
| 2002/0108312 | A1 * | 8/2002 | Abdella et al. | 49/382 |

* cited by examiner

INSTALLATION METHOD FOR A STORM DOOR

CROSS-REFERENCE TO RELATED APPLICATION(S)

This application claims the benefit of U.S. provisional application 60/642,847, filed Jan. 11, 2005, which is hereby incorporated by reference in its entirety.

FIELD OF INVENTION

The present invention relates generally to a storm door. More particularly, the present invention relates to methods and apparatuses for an easy installation pre-assembled storm door.

BACKGROUND OF THE INVENTION

For many years storm doors have been produced and utilized to provide an extra measure of thermal insulation and weather protection at door openings of a building. Storm doors are currently formed of one or more panes of glass seated within a surrounding doorframe. Storm doors may include panes that are movable within the door, or may be provided with a removable window pane that may be replaced with a screen to provide ventilation. Storm doors may be installed on a building or home long after the initial building construction. In many cases a homeowner who is not an expert in construction installs storm doors. The storm doors installed by the homeowner may be a custom manufactured door or may be a generic one-size-fits-all type door that is mass produced. Ease of installation is an obvious benefit for storm doors installed by the layman homeowner, as well as for professional installers desiring to minimize the time spent at a jobsite.

Easy install storm doors are often pre-assembled and pre-hung at the factory where they are manufactured. Factory assembled pre-hung doors normally include a door secured by hinges to a surrounding frame. The factory-assembled units may be mounted for opening in either a right or left hand direction. Other door and doorframe combinations may come in an unassembled condition wherein few or no holes are pre-drilled and various parts must be cut to size. In such combinations the installer may be required to drill many holes in the door and in the frame and to cut the door, frame, or other portions to insure the proper fit. This arrangement requires the user to have a certain degree of skill to mount the door. Moreover, installation of these door combinations may take many hours of work for the average layman without the help of a skilled installation expert.

BRIEF SUMMARY OF THE INVENTION

The present invention is a pre-assembled door system for easy installation that can be installed in a right hinge or left hinge manner while utilizing the same locking assembly.

One embodiment of the present invention is furthermore a method of installing a door system pre-mounted to a vertical z-bar.

Another embodiment of the present invention is an express install kit for installing a storm door in a doorframe including a door panel for insertion into the doorframe in either a right hinge or a left hinge orientation, a hinge z-bar and a latch z-bar, the hinge z-bar pivotally mounted to a first side of the door panel and the latch z-bar removably secured to a second side of the door panel, the hinge z-bar allowing the door panel to open in one direction in relation to one side of the door panel, the hinge and latch z-bars being fixedly securable to the doorframe, a lockbody installed in the door panel, the lockbody including duplicate lock hardware receiving structures such that the door panel can be situated in the doorframe in the right hinge or the left hinge orientation, and one or more door closing assemblies, the closing assemblies including jamb bracket bases, jamb brackets, door brackets, and closers, the jamb bracket bases mountable onto the doorframe in a guided position by aligning a guide indicia on the jamb bracket base with an indicator on the door panel and z-bar, the jamb brackets securable to the jamb bracket bases, the door bracket securable to the door panel, and the closers linking the jamb brackets and the door brackets with a desired amount of tension.

Another embodiment includes a door closer assembly for a storm door with a jamb bracket base, the jamb bracket base mountable onto a doorframe surrounding the storm door in a guided position by aligning a guide indicia on the jamb bracket base with an indicator on the storm door and a door closer of variable length with an installation length predetermined and preset at the factory, the door closer secured between the jamb bracket base and the storm door whereby when the storm door is in a closed position the door closer is at the installation length.

Yet another aspect of the invention includes a lockbody for a pre-assembled storm door comprising a lockbody installed in the storm door, the lockbody including duplicate lock hardware receiving structures situated in a mirror format across a horizontal plane, the lockbody placed into the pre-assembly storm door whereby the door panel can be situated in a doorframe in a right hinge or a left hinge orientation.

Another embodiment includes a method for installing a door into a doorframe including providing a door panel with an external surface, a hinge z-bar, and a latch z-bar, the hinge z-bar pivotally mounted to a first side of the door panel and the latch z-bar removably secured to a second side of the door panel, orienting the door panel for either a right hinge or a left hinge operation so that the external surface faces an external side of the door frame, attaching a bottom expander to a bottom side of the door panel, the bottom expander attachable in a selected position on the door panel, the bottom expander including a bottom spacer for insuring a correct spacing between the door panel and the bottom of the doorframe, setting the door panel in the doorframe and securing the hinge z-bar and the latch z-bar to the doorframe such that the door panel is free to swing between a closed position and an open position, securing a top mounting frame to the top of the doorframe, the top mounting frame extending between the door panel and the doorframe, the top mounting frame including a spacer for insuring the top mounting frame is properly positioned relative to the door panel, inserting a key cylinder into one of two symmetrical lock hardware receiving structures on a mortise lockbody mounted in the door panel, aligning one or more jamb bracket bases onto the doorframe in a desired position by matching a guide indicia on the jamb bases, mounting one or more closers to each jamb bracket base and attaching the closers to the door panel, the closers being of variable length but releasably secured at an installation length; releasing the one or more closers, and adjusting the position of the bottom expander relative to the doorframe to lightly contact the bottom side of the doorframe.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive.

DETAILED DESCRIPTION

The present invention is a pre-assembled door system 50 for quick and easy installation. While it is recommended that two or more people install door system 50 for safety reasons, the total installation may be accomplished by one person of reasonable competency in one hour or less. Moreover, the installation of the door system 50 may be accomplished with a minimum of tools and a minimum of cutting, drilling, etc. The door system 50 described below is for a storm door, but, as may be appreciated, this invention is not strictly limited to storm doors. Other types of doors and windows may also be included within the teachings of the present invention.

The door system 50 of the present invention includes a storm door 52 that is pre-assembled as opposed to pre-hung. The orientation in the left hand or right hand is not selected until the time of installation. On a pre-hung door the jambs and header are part of the door assembly. The present invention door system 50 does not require the user installing the storm door 52 to drill into or cut off any portion of the storm door 52 as provided. The only holes that need to be drilled by the installer may be pilot holes in a doorframe of the building.

Figure 1B:
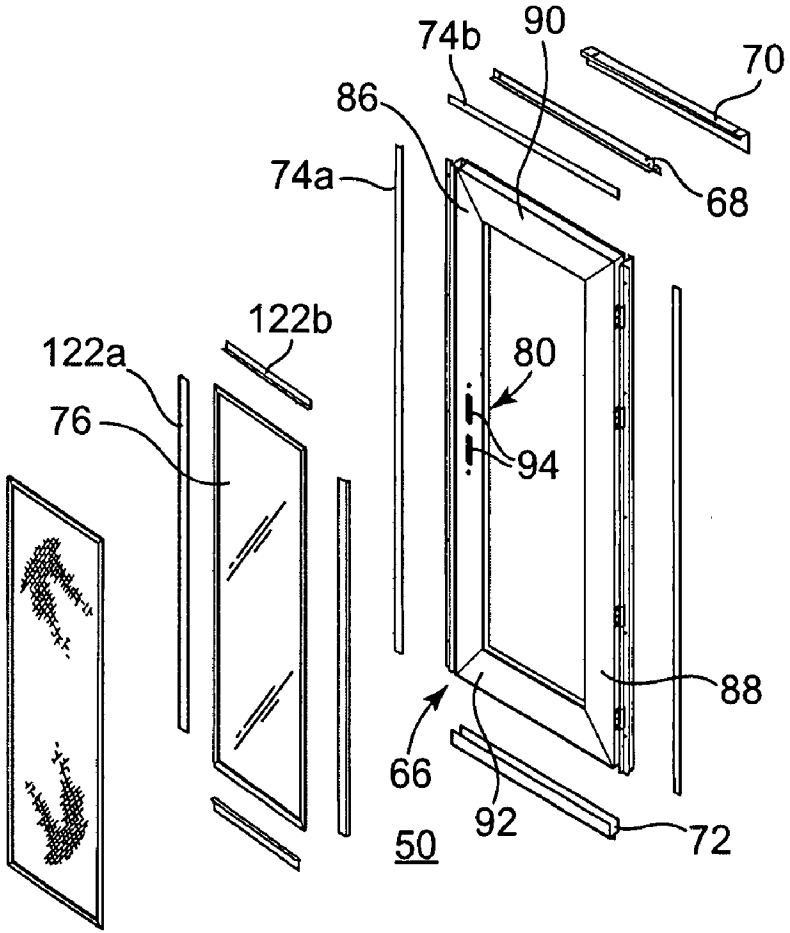
FIG. 1 is an exploded view of the elements of the present invention door system.
Figure 1A:
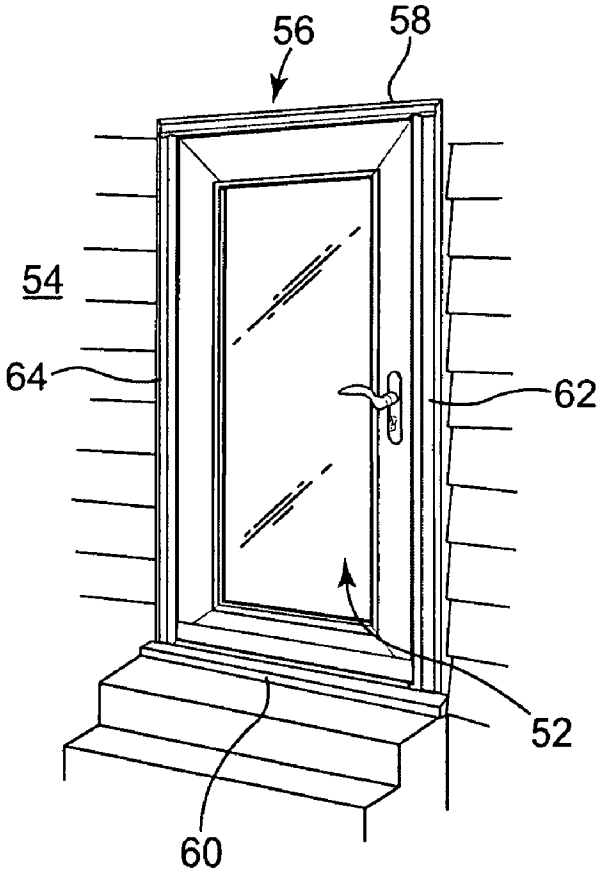
Figure 3:
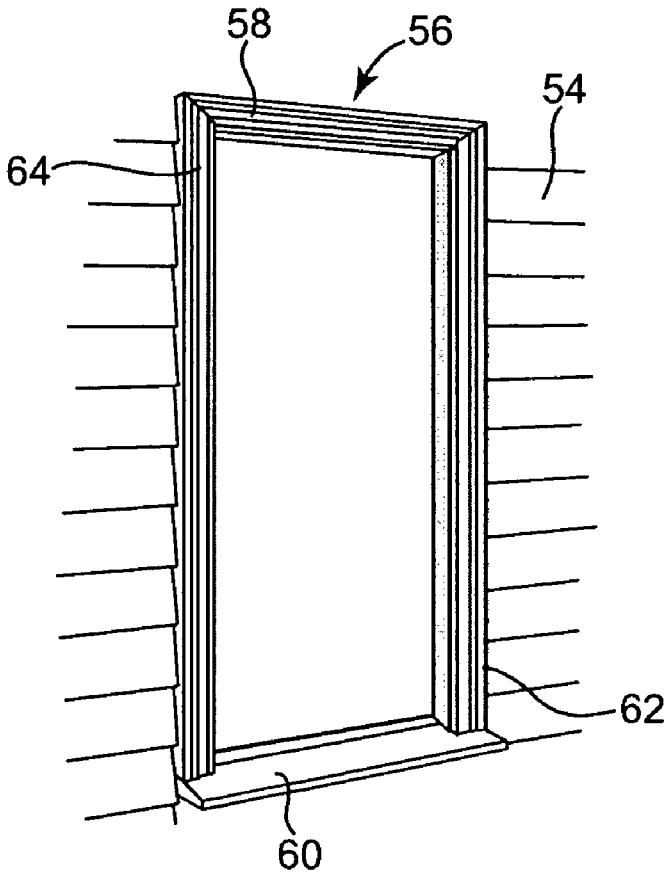
FIG. 3 illustrates the steps required to shim the doorframe to the proper size.
Figure 7B:
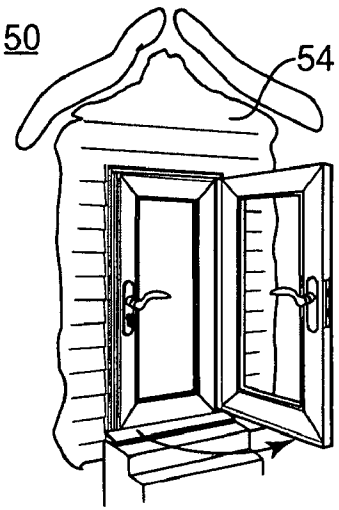
FIG. 7 illustrates a right hinge versus a left hinge door orientation.
Figure 7A:
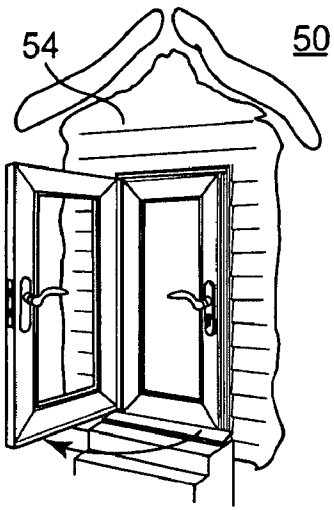

The present invention description is put forth in view of installing the storm door 52 in a house 54. As illustrated in FIGS. 1, 3, and 7, the house 54 may have a wall with a doorframe 56 wherein the storm door 52 is to be installed. The doorframe 56 may include a top 58, a bottom 60, and two vertical sides 62, 64. One of the vertical sides may be referred to as a vertical hinge side 64 and one may be referred to as a vertical latch side 62. The vertical hinge side 64 is that side where hinges of the storm door 52 will be attached.

As illustrated in FIG. 7, the door system 50 of the present invention may be mounted in a right hinge or left hinge orientation. (Terms such as "left" and "right" are from a position standing outside the house 54 unless otherwise specified.) In other words, the door system may be "reversible" in that it can be installed to swing open from either direction. If the door system 50 were to be mounted in a right hinge configuration, the door handle will be on the left side of the storm door 52 and the hinges will be on the right side of the storm door 52. If the door system 50 were to be mounted in a left hinge configuration, the door handle will be on the right side and the door hinges will be on the left side. The description of the present embodiment will focus on installing the storm door 52 in a right hinge format. As may be appreciated, the storm door 52 of the present embodiment, when switched from a right hinge to a left hinge format the storm door 52 is rotated in a plane such that the same face of the storm door always faces the exterior of the house 54. Whether a right hinge or left hinge format is selected, the same face of the door panel will face out of the house and the same edge of the door panel will be the vertical hinge side and the same edge will be the vertical latch side. The door, in essence, will work with either the top or bottom of the door positioned at the top or bottom of the door frame.

With reference to the enclosed figures, the components of the present invention will first be described. Afterwards, a description of installing the door system 50 in view of utilizing these components will be put forth. As may be appreciated, the door system 50 may include a number of alternative and/or additional components. Moreover, each component can be a number of different sizes or shapes and may be attached in a number of different ways, including screws, pins, nails, friction fittings, etc. The present embodiment is therefore described in view of the embodiment illustrated in the drawings and described with an eye towards the function of each component rather than just the strict size and shape of each component or how each component is fastened in position. Moreover, the purpose for each component of the door system 50 may not be immediately and readily apparent until the component is discussed or referred to in terms of installing the door system.

The Door System Components

Figure 4:
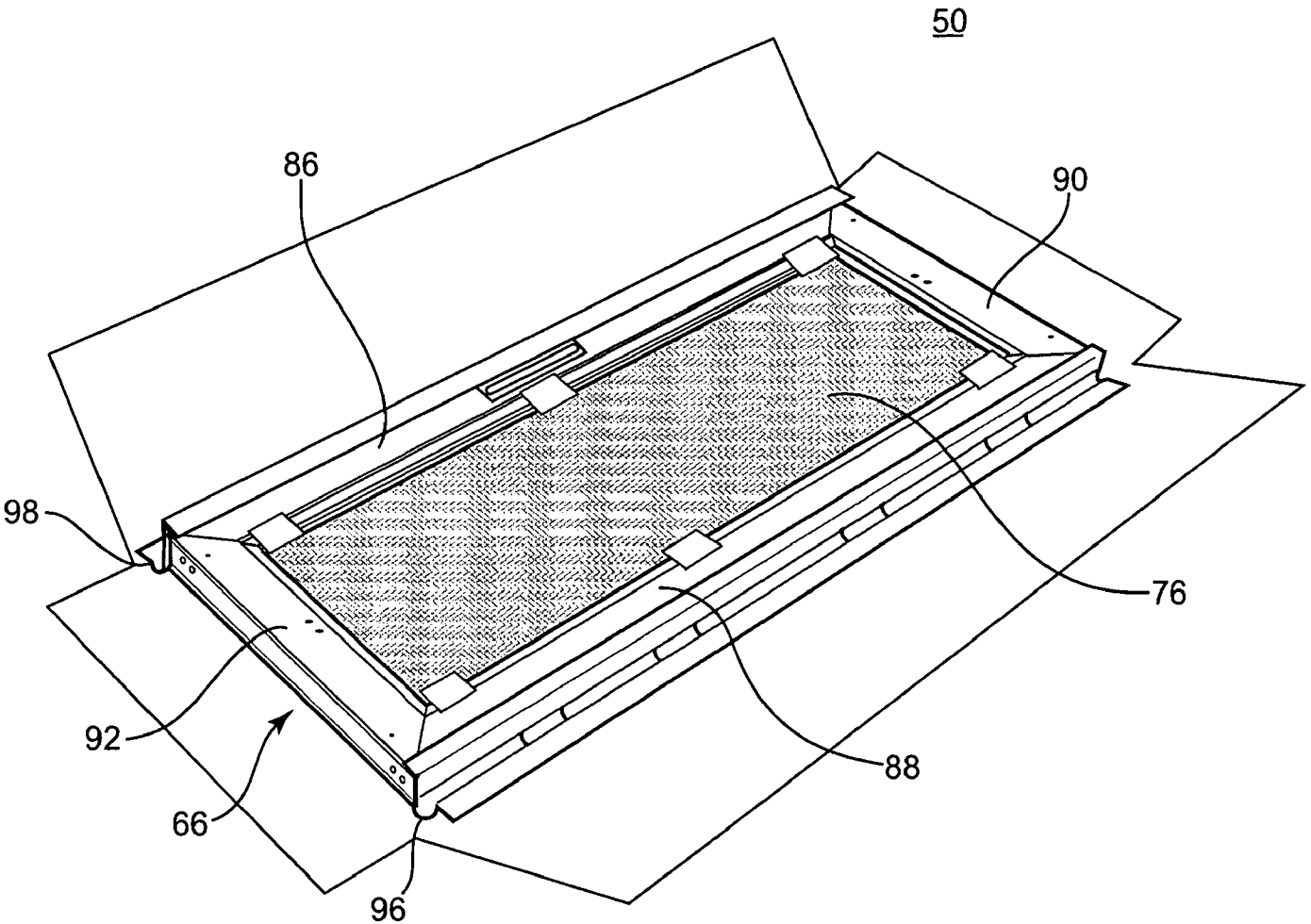
FIG. 4 is an example packaging system for the present invention door system.

The door system 50 may come packaged together in one box for easy shipping. Such a door system may be referred to as a "kit" or a "door kit." The door kit is illustrated in FIGS. 1 and 4. As illustrated in FIG. 1, the door system 50 may include a door panel 66, a top mounting frame 68, a header frame 70, a bottom expander 72, and screw cover strips 74*a* and 74*b*. The door system 50 may further include a glass 76 (or screen), and a number of retaining strips 122*a* and 122*b* and may also include a lock assembly 80 and a top and bottom closer assembly 82, 84.

The door panel 66 may be the main body of the storm door 52 (minus the glass or screen) and will be referred to herein as a "door panel" to differentiate clearly between the various items with "door" in the name and the completed storm door 52 that includes many of the other components of door system 50. The door panel 66 included in the door system 50 may be a door of conventional construction and may be of any standard size. The size of the existing doorframe 56 may determine the size of the door panel 66 that needs to be installed therein. Different door systems 50 may include door panels 66 with different dimensions.

The door panel 66 may be any type of door panel known to those in the art, such as including four piece, one piece, extruded hollow, laminated, molded, or an arch top. The door panel 66 includes a latch side 86, a hinge side 88, a top side 90, and a bottom side 92. The latch side 86 of the door panel 66 may include the lock assembly 80 mounted therein and a series of cutouts 94 that expose and give access to the lock assembly 80. The hinge side 88 and the latch side 86 may both include a hinge z-bar 96 and a latch z-bar 98, respectively. As may be appreciated, the "top" and "bottom" of the door panel 66 may be switched depending on whether a right hinge or left hinge installation is selected.

Figure 8:
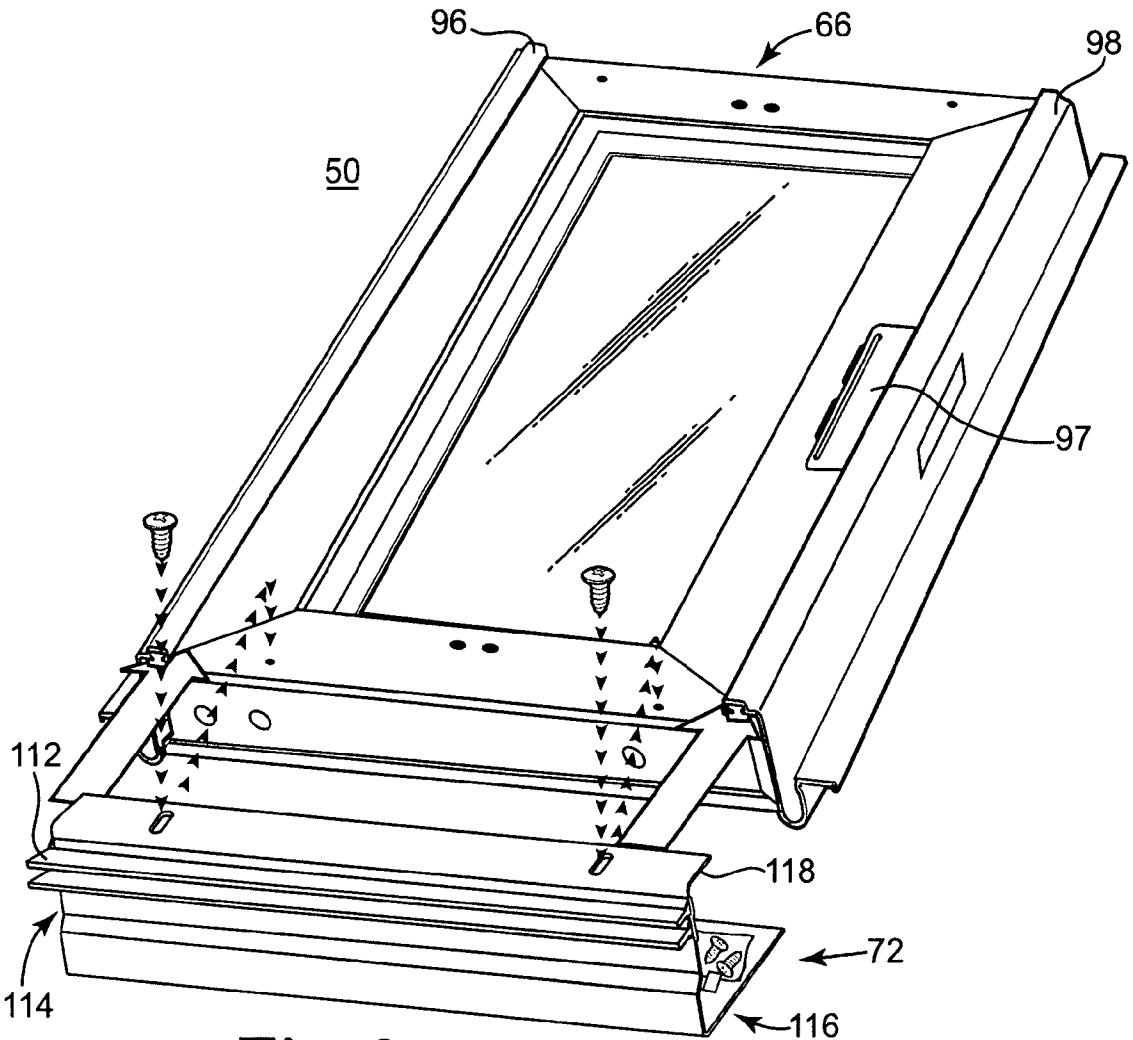

As illustrated in FIG. 8, the hinge and latch z-bars 96, 98 may be, in effect, vertical jambs on either side of the door panel. The hinge and latch z-bars 96, 98 may be extruded or roll-formed metal, such as for example aluminum. The hinge z-bar 96 should be strong enough to maintain the weight of the storm door 52 when it is in an open or closed position. The hinge z-bar 96 may be mounted at the factory in a pivotal relationship to the door panel 66. Likewise, the latch z-bar 98 may be removably affixed to the door panel 66. The hinge z-bar 96 may include a hinge arrangement (not shown) attached between the door panel 66 and the hinge z-bar 96. The hinge arrangement may allow the door panel 66 to finally swing open or closed after the door system 50 is installed. The hinge and latch z-bars 96, 98 may be cut to a length that is shorter than the height of a standard doorframe 56 so that the z-bars 96, 98 do not have to be cut to fit the height of the doorframe 56 during installation. As such, when the door panel 66 is placed in the doorframe 56 during installation there may be a gap remaining between the top side 90 of the door panel 66 and the top 58 of the doorframe 56. In some cases, however, this gap may not be present.

The latch z-bar 98 may also include a shipping plate 97 illustrated in FIG. 8. The shipping plate 97 may be screwed to the latch z-bar 98 and may include a number of flanges that engage in holes in the door panel 66. As is further illustrated in FIGS. 11, 14, and 35, the shipping plate 97 may keep the latch z-bar 98 and the door panel 66 properly aligned during shipping and installation.

Figure 14B:
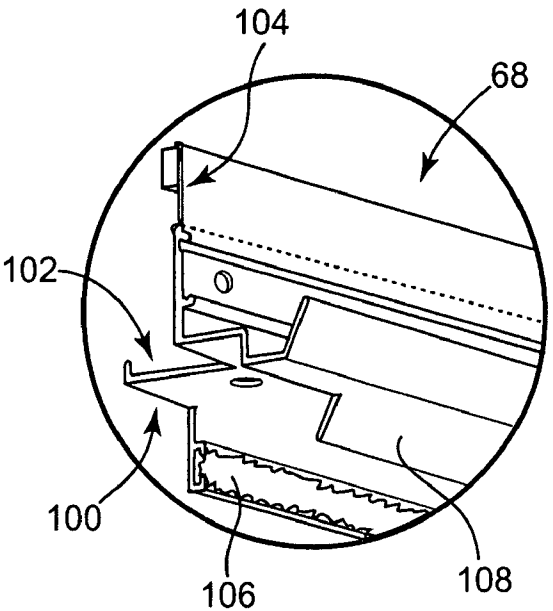
FIGS. 14-16 illustrate installation of the top mounting frame.
Figure 14A:
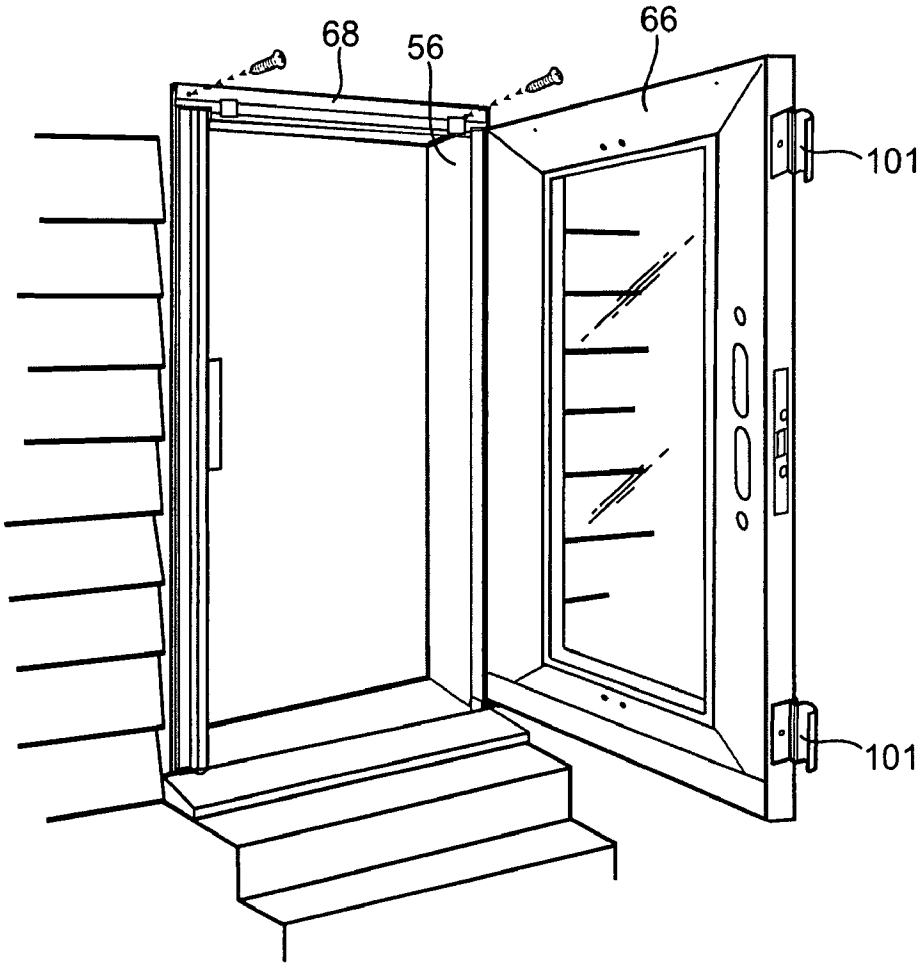

As shown in FIGS. 1 and 14, the top mounting frame 68 may be of a shape as shown in the figures for horizontal mounting to the doorframe 56. The top mounting frame 68 may create a relatively complete seal between the door panel 66 and the doorframe 56. The top mounting frame 68 may include a bottom side 100 and a top side 102. The top side 102 may include a vertical flange 104 extending substantially vertically from the top side 102, the flange 104 including one or more screw holes for securing the top mounting frame 68 to an exterior of the doorframe 56 on house 54. The bottom side 100 of the top mounting frame 68 may include a door stop 106 and a door finger 108. The door stop 106 and the door finger 108 may extend longitudinally from the bottom side 100 of the top mounting frame 68. The door stop 106 may help to define the closed position of the door panel 66 and may include a weather strip along an edge facing the door panel 66 for creating an air and thermal barrier. The stop 106 is not necessarily a structural stop in the sense of a stop that prevents the door from moving further, but may be a stop in the sense that it approximately defines that point where the door panel 66 is fully closed. In addition, the door panel 66 may actually bend the door stop 106 slightly when it makes contact thereto to help create a tighter air and thermal barrier. The door finger 108 may engage the top edge 102 of the door panel 66 to further help to create an air and thermal barrier between the top mounting frame 68 and the door panel 66 when the door panel 66 is in the closed position. The finger 108 may extend at a slight angle from the bottom side 100 of the top mounting frame 68 so as to facilitate engagement with a top side 102 of the door panel 66. As is further shown in FIGS. 15 and 15A, the top mounting frame 68 may further include two factory installed spacers 110. The factory installed spacers 110 may be removably positioned to cover a bottom side 100 of the top mounting frame 68. The purpose of the spacers 110 is further discussed in the details for installing the door assembly.

Figure 6:
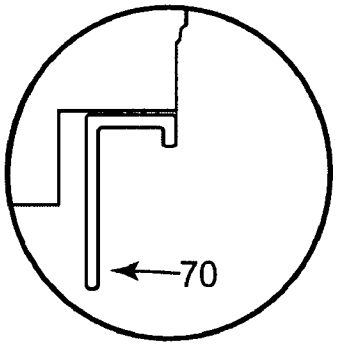
FIGS. 5-6 show the installation of the header frame of the present invention.
Figure 5:
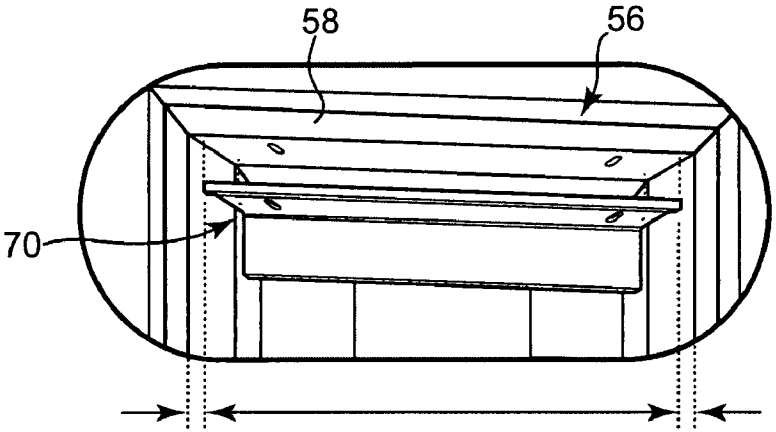

As illustrated in FIGS. 5 and 6, the header frame 70 may be a generally L-shaped bracket as shown. The header frame 70 may be for mounting on the top 58 of the doorframe 56 and may include a number of screw holes pre-drilled at the factory. The header frame 70 may insure, along with the top mounting frame 68, that the door panel 66, after being mounted in the doorframe 56, does not have a gap between the top side 90 of the door panel 66 and the top 58 of the doorframe 56. The top mounting frame 68 and the header frame 70 may be considered a two piece header. Moreover, the smooth back side of the header frame 70 that faces the interior of the house 54 may present an aesthetic view. The header frame 70 may have a width preferably no more than ¼" shorter than the doorframe 56 width (measured to include shims) into which the door system 50 in installed.

Figure 9:
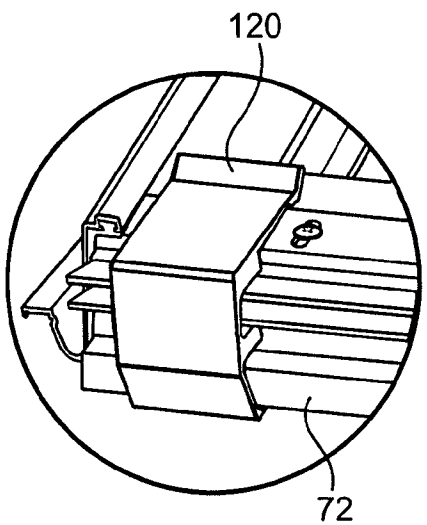
FIGS. 8-9 and 26 illustrate the door system and bottom expander of the present invention.
Figure 26:
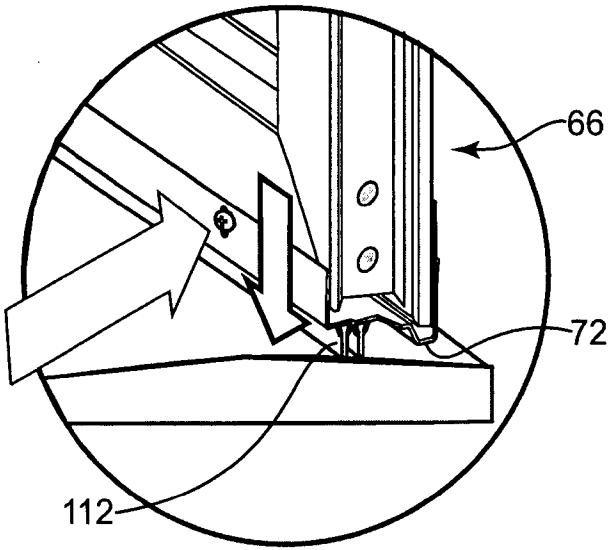

As illustrated in FIGS. 8, 9, and 26, the bottom expander 72 may be a generally U-shaped body (with one side somewhat shorter than the other side) as shown in the figures and may include one or more parallel sweeps 112 running longitudinally along a bottom side 114 of the bottom expander 72. One side of the bottom expander 72 may be referred to as the exterior face 116 and the other side may be referred to as the interior face 118. The bottom expander 72 may include one or more holes provided at the factory, on the exterior face 116 at a predetermined spacing. The pre-drilled holes may be of a size and shape to receive screws therethrough. Moreover, mating holes may be provided on the door panel 66. The bottom expander 72 may be selectably positionable on the door panel 66 so as to allow for adjustment of the height of the door panel 66 plus the bottom expander 72, and to allow for variation in the height of the opening or variation in the sill. In further embodiments, the bottom expander 72 may be one or more flat or L-shaped members.

The bottom expander 72 may also include a bottom spacer 120. The bottom spacer 120 may be a generally U-shaped body designed to fit over the bottom expander 72. The bottom spacer 120 may be of a size and shape to be connected over the bottom expander 72 with the flanges engaging the bottom surface 114 of the bottom expander 72. The bottom spacer 120 may be snapped over the bottom expander 72 by friction fitting but may, in alternative embodiments, be secured to the bottom expander 72 by screws, snaps, etc.

Figure 27B:
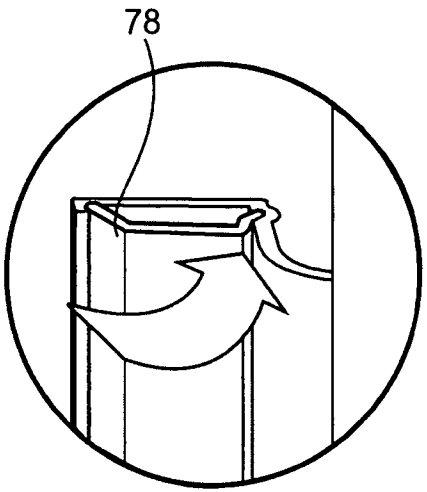
FIG. 27 illustrates the installation of the cover strips of the present invention.
Figure 27A:
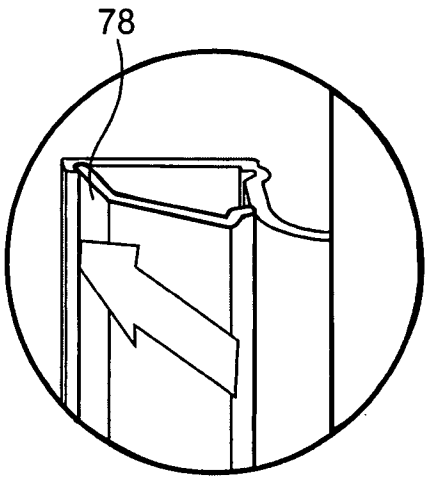
Figure 28:
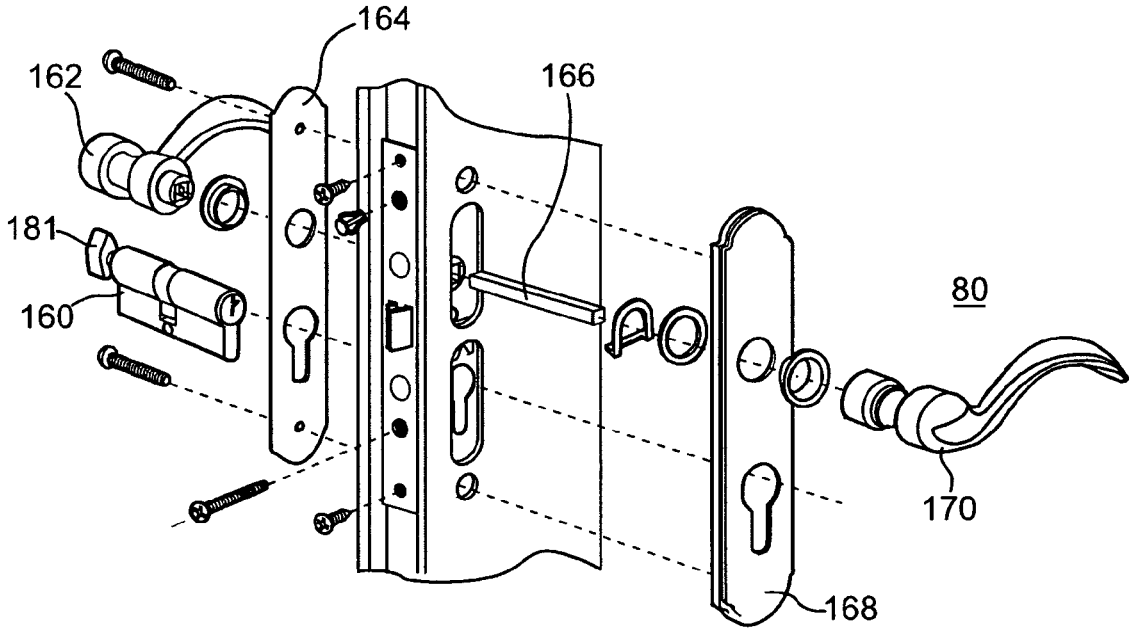
FIGS. 28-37 and 42-46 illustrate the lock assembly of the present invention and the installation of the same.
Figure 29:
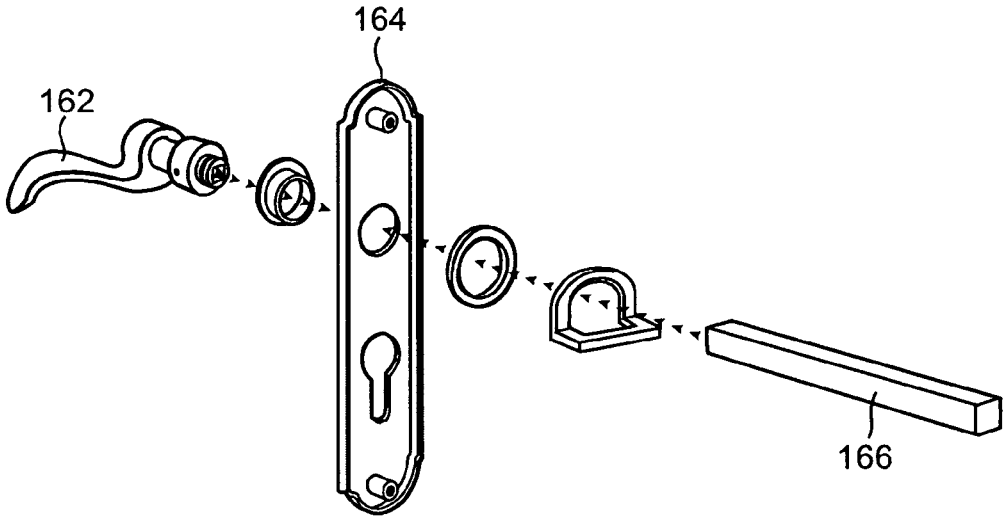
Figure 30:
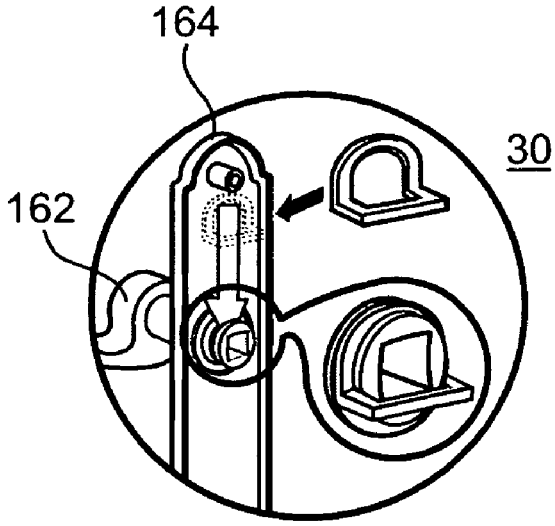
Figure 31:
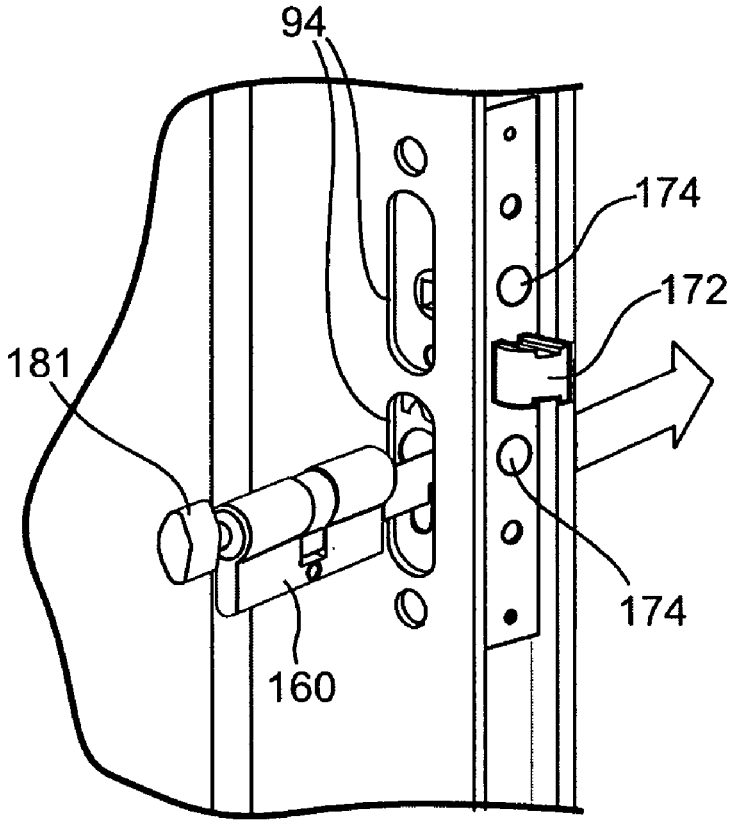
Figure 32:
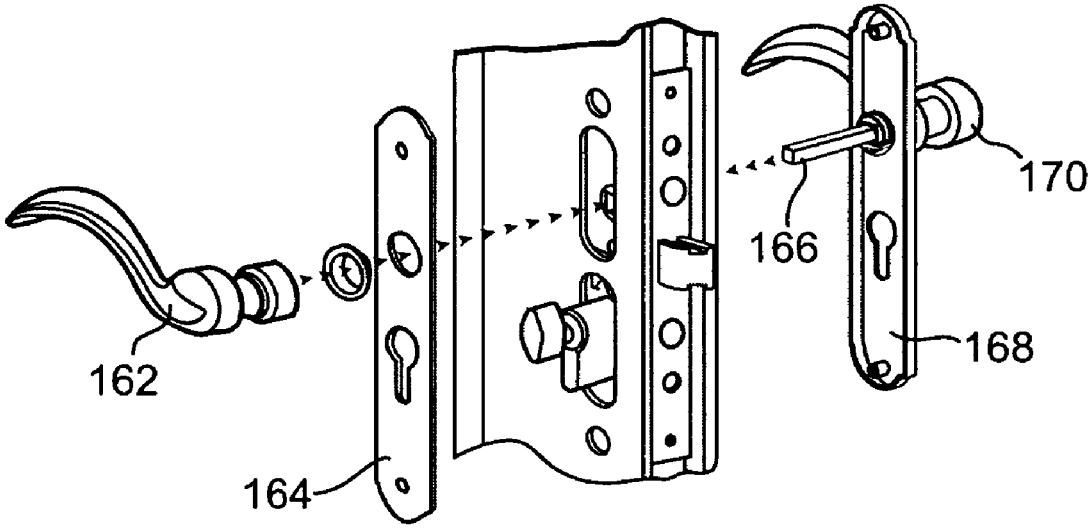
Figure 33:
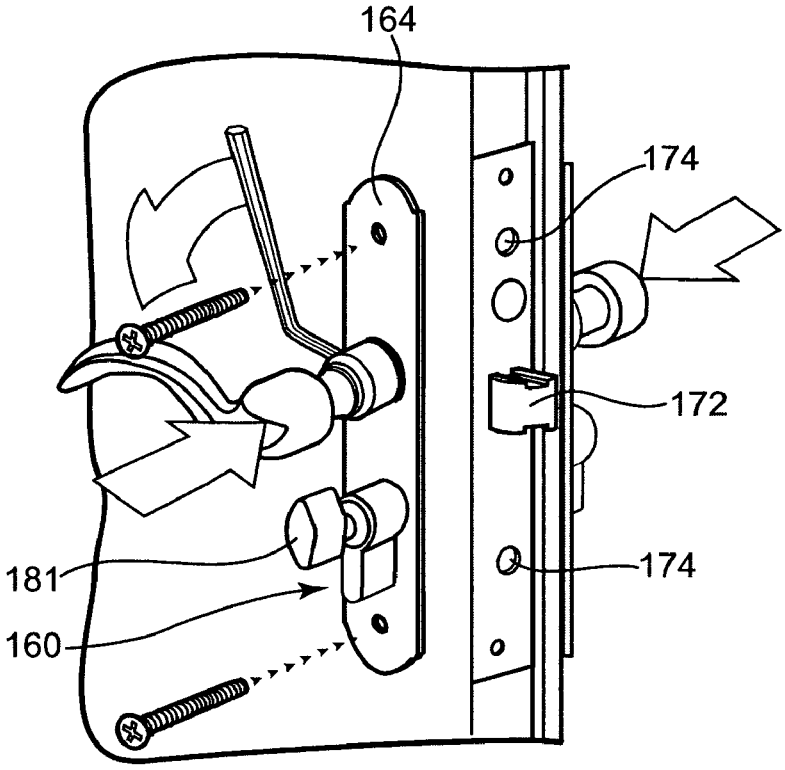
Figure 34:
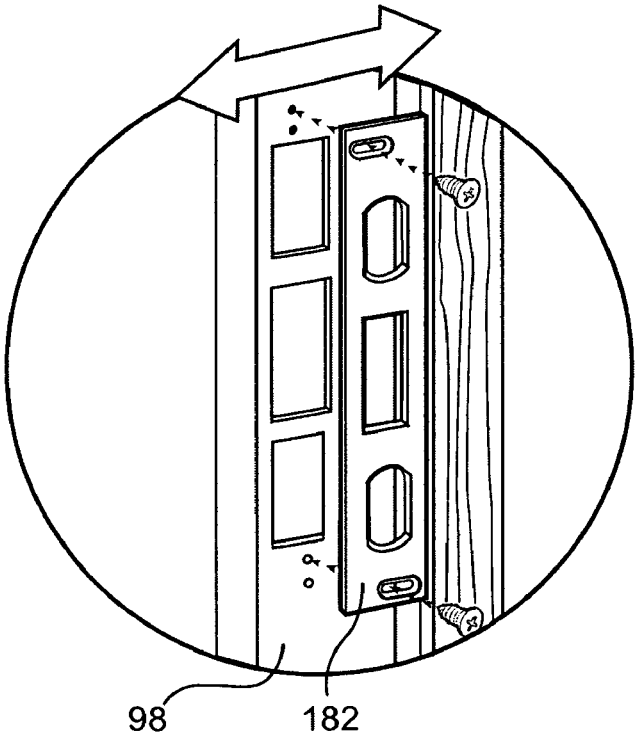

As illustrated in FIGS. 1 and 27, the screw cover strips 74*a* and 74*b* may be rectangular shaped plastic strips 122*a* and 122*b* that are of a size and shape to snap fit to a portion of the hinge and latch z-bars 96, 98. The screw cover strips 74*a* and 74*b* may be made of any material desired and may be for purely cosmetic purposes.

Figure 12C:
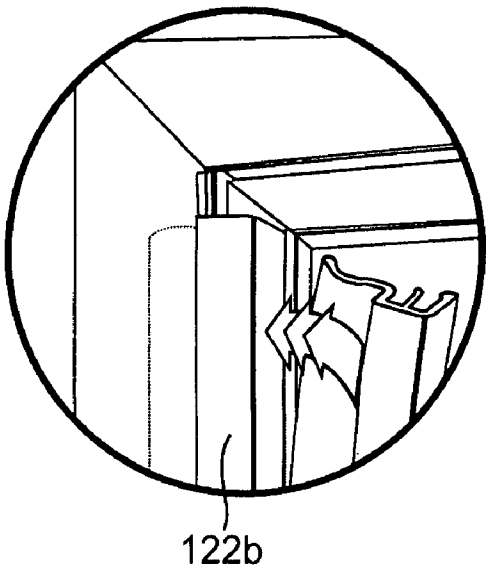
FIG. 12 illustrates placement of the glass panel in the door panel.
Figure 12B:
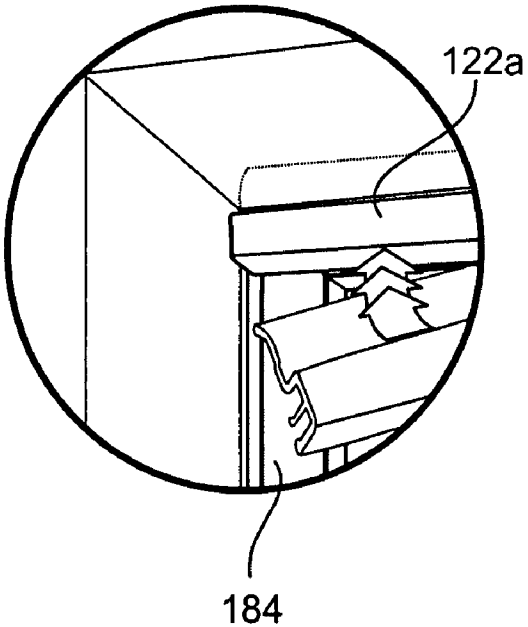
Figure 12A:
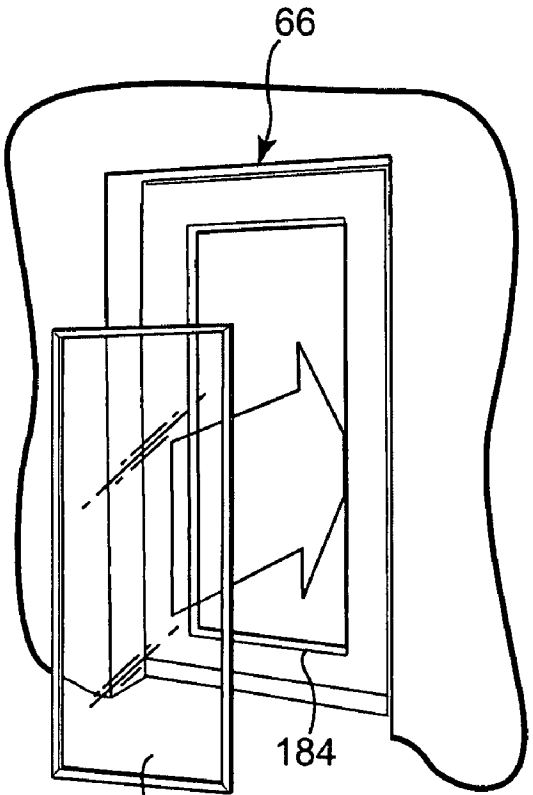

As is further illustrated in FIGS. 1 and 12, the glass pane 76 may be a generally rectangular glass element sized to fit into the door panel 66. The glass pane 76 may not be limited to just a uniform piece of glass, but may, alternatively, include a screen in place of or in addition to the glass. The glass pane 76 may be held in place by one or more retaining strips 122*a* and 122*b*. The retaining strips 122*a* and 122*b* of the present embodiment may include two horizontal retaining strips 122*a* and two vertical retaining strips 122*b*. Each retaining strip 122*a*, 122*b* may include a shaped main body with a snap fitting designed to secure the retaining strip 122*a*, 122*b*, and therefore the glass pane 76, to the door panel 66. The retaining strips 122*a*, 122*b* may be made of any material desired. Alternatively, the glass pane 76 may be permanently glazed to the door panel 66.

As shown in FIGS. 17-25 and 38-41, each top and bottom closer assembly 82, 84 may include a top 124 and bottom closer 126, a top and bottom jamb bracket base 128, 130, a top and bottom jamb bracket 132, 134, and a top and bottom door bracket 136, 138. The top and bottom closers 124, 126 may be standard closers known to those of skill in the art. In alternative embodiments, the closers 124, 126 may include spring members or other motive means and may also include a system for securing the door in an open position. The top and bottom jamb bracket base 128, 130 may each be in the form of a generally rectangular plate with a number of screw openings 140 therein. A first and second side of each jamb bracket base may include a number of slide connectors 142. The slide connectors 142 are for engaging the top and bottom jamb brackets 132, 134. As will be appreciated during the description of the installation, the slide connectors 142 may be replaced by a number of other fittings that are known to those of skill in the art, such as, but not limited to, snap fittings, screws, release tabs, etc. Moreover, each jamb bracket base 128, 130 of the present embodiment may further include one or more detachably connected hole plugs 144 that may be utilized to fill pre-drilled screw holes in the door panel that are not utilized during installation.

In addition, each jamb bracket base may include an alignment tab 146. The alignment tab 146 may be of a predetermined size and shape so as to help correctly position each jamb bracket base 128, 130 relative to hinge z-bar 96, and in turn door panel 66, during installation. The jamb brackets 132, 134 may each include a base 150 and a head 152. The base 150 includes a hollow interior cavity 148 for receiving the slide connectors 142 of the jamb bracket base 128, 130. The head 150 may be generally shaped in an arch and include a pin receiving hole 154. The jamb bracket base 128, 130 may also include a tongue 131. The tongue 131 lockingly secures the top and bottom jamb bracket 132, 134 to the corresponding jamb bracket base 128, 130. However, the tongue 131 can be depressed to easily remove the jamb bracket base 128, 130 and therefore the entire top and bottom closure assembly 82, 84. This may be particularly useful when moving large objects through the door system 50 and the storm door needs to be opened to its fullest extent.

The top and bottom door brackets 136, 138 may include a number of pre-drilled holes for securing the door brackets 136, 138 to the door panel 66 and also a pin means for securing the door brackets 136, 138 to the top and bottom closers 124, 126.

In the present embodiment the top and bottom jamb brackets 132, 134 may already be pivotally secured to the top and bottom closers 124, 126, respectively. The top and bottom closers 124, 126 may each include a shaft 156 that extends longitudinally from the closer. The shaft 156 may be secured to the top and bottom jamb brackets 132, 134 in a pivotal orientation. The function of the shaft 156 may be well known in the art. The top and bottom closers 124, 126 may also include a clip 135 on the shaft to maintain the closer 124, 126 at a desired installation length until after the closers 124, 126 are installed. The installation length may be predetermined at the factory such that it will create the proper tension to properly and completely shut the door panel. As may be appreciated, the clip 135 may be replaced with any type of pin, snap, bracket, o-ring, snap ring, etc. Such a pre-assembled top and bottom closer 124, 126 may aid in quick installation of door system 50.

The various portions of the door system 50 may be made of any suitable material. In many cases, pieces such as the hinge and latch z-bars 96, 98 may be made of extruded metal. In addition, other pieces may be made of forged metal, plastics, high density plastics, wood, etc. The door panel 66 may include portions made of wood, aluminum, steel, fiberglass, plastic, and other suitable materials.

As illustrated in FIGS. 28-37, the lock assembly 80 may further include a lockbody 158, a key cylinder 160, a first handle 162, an interior escutcheon 164, a spindle 166, an exterior escutcheon 168, and a second handle 170. The lock assembly 80 may further include a number of screws, retaining clips, washers, bushings, etc. that may be necessary to assemble a functioning lock, but which will not be individually described herein. The lockbody 158 is the main body of the lock assembly 80 to which the other elements are affixed or attached. The lockbody 158 may be installed in the door panel 66 and visible and accessible through cutouts 94 in the door panel, the cutouts 94 facing the interior and exterior of the house 54. The lockbody 158 may be constructed with an upper and lower lockbody 158*a*, 158*b* that may be a mirror image. In other words, the lockbody 158 may include duplicate lock hardware for receiving the other portions of the lock assembly 80 depending on the orientation of the door panel 66. The centerline of the mirror image may run along a center of a latch bolt 172. Each of the upper and lower lockbody 158*a*, 158*b* may include a dead bolt 174, a spindle receiving lumen 176, a key cylinder receiving member 178, the latch bolt 172, and a number of screw receiving holes 180. The lock assembly 80 is generally symmetrical about a horizontal axis and, when placed in a double door arrangement, allows the doors to have a consistent handle height. A locator 163 on the lock assembly 80 insures that the lock assembly 80 is properly positioned in the door panel 66 during construction. Clips 165 may also insure the correct location of the lock assembly in the door panel 66. Clips 165 may be spring loaded or friction fitted.

The interior and exterior escutcheons 164, 168 may be the faceplates of the lock assembly 80 below the handles 162, 170 and may be any desired ornamental configuration. The spindle 166 may be a longitudinal shaft of a certain shape designed to engage the first and second handle 162, 170 so as to rotate in unison. The key cylinder 160 may be the body that controls the extension and retraction of the dead bolt 174 and may include a first end into which a key may be inserted and a second end with a thumb latch 181. The spindle 166 is normally square shaped when viewed from one end and fits through the spindle receiving lumen 176 that is specifically shaped and sized to receive the spindle 166. The operation of the spindle 166 and spindle receiving lumen 176 to move the latch bolt 172 when activated by the first or second handles 162, 170 may be well known to one skilled in the art. In the present embodiment, the spindle receiving lumen 176 may be positioned on the opposite side of the latch bolt 172 from the corresponding key cylinder 160 first end. In the present embodiment lock assembly 80 the latch bolt 172 may be retracted to open and close the door by simply turning the first or second handle 162, 170. The deadbolt 174 may be that portion of the lock assembly 80 that can be engaged into a locked position.

Figure 35:
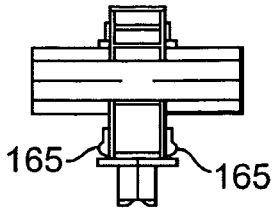
Figure 36:
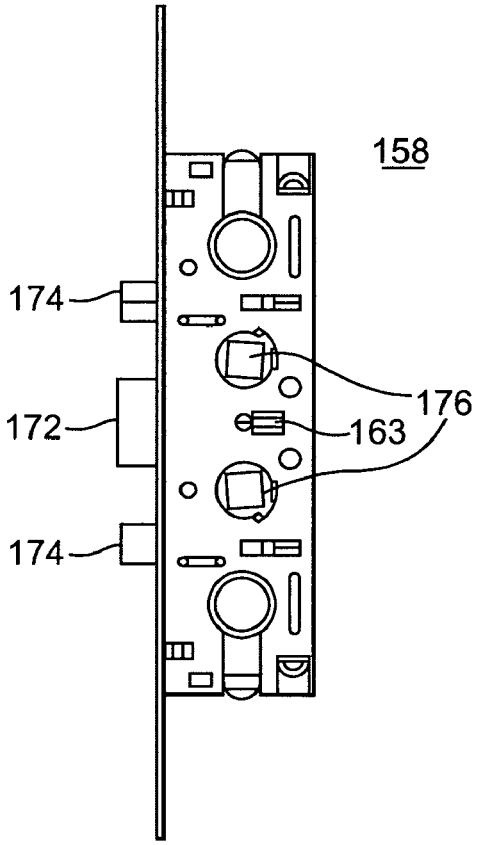
Figure 37:
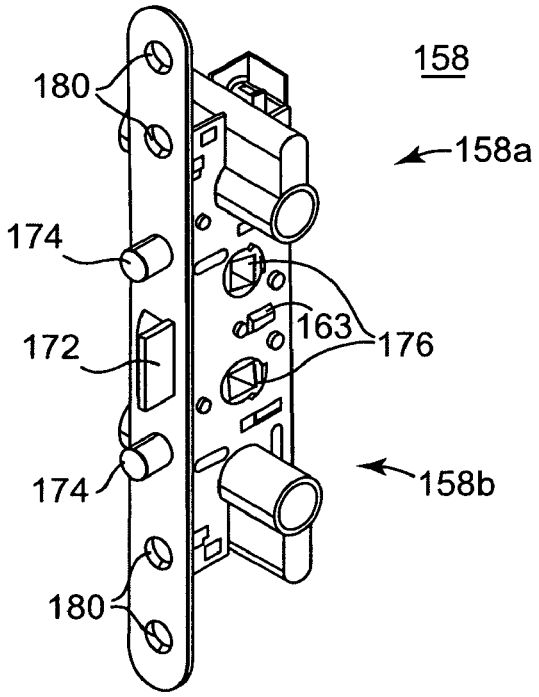
Figure 38:
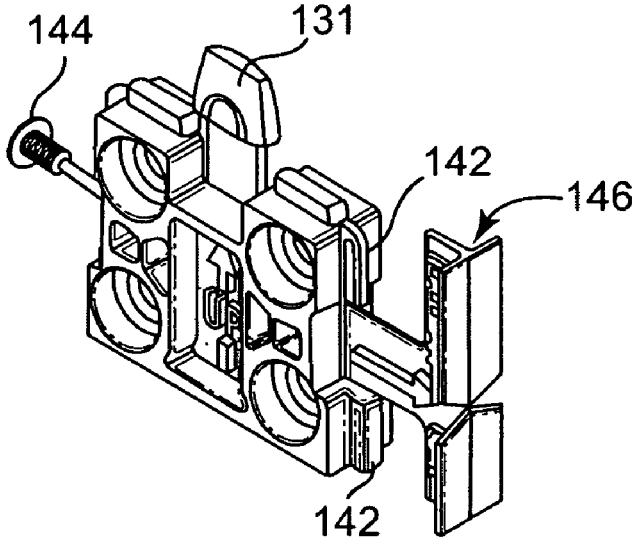
FIGS. 38-39 illustrate the jamb bracket base of the present invention
Figure 39:
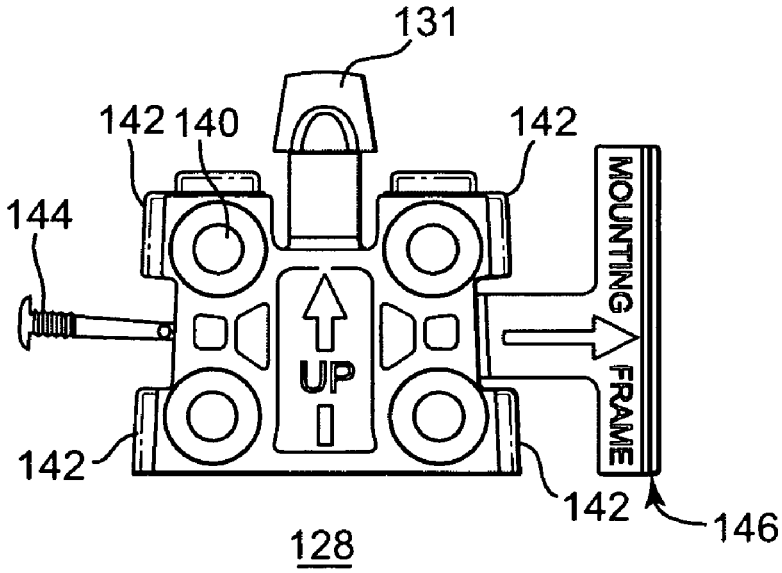
Figure 40:
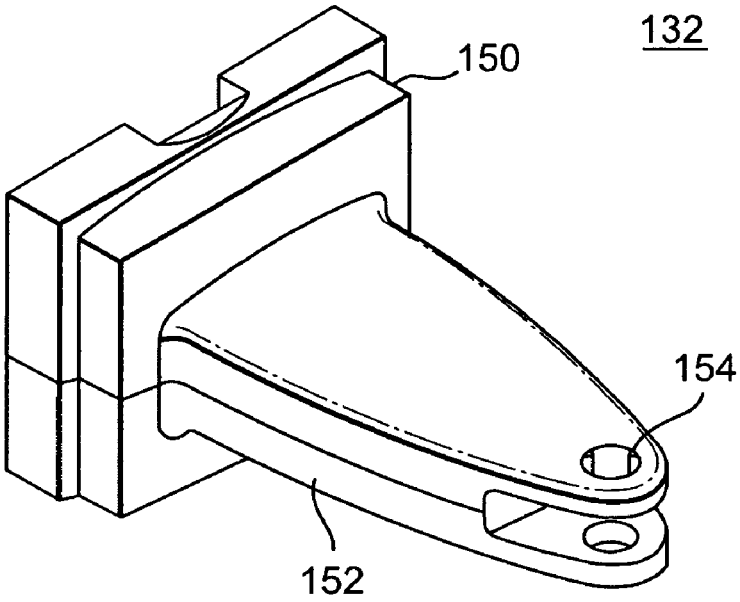
FIGS. 40-41 illustrate the jamb bracket of the present invention.
Figure 41:
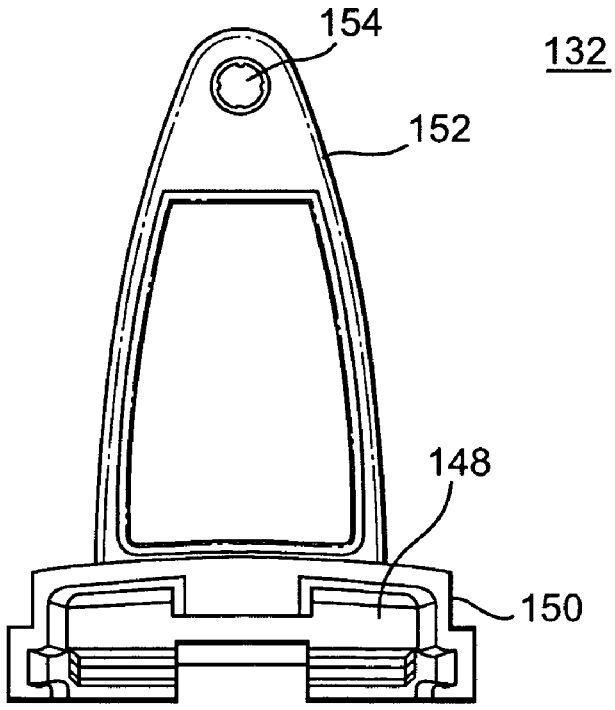
Figure 42:
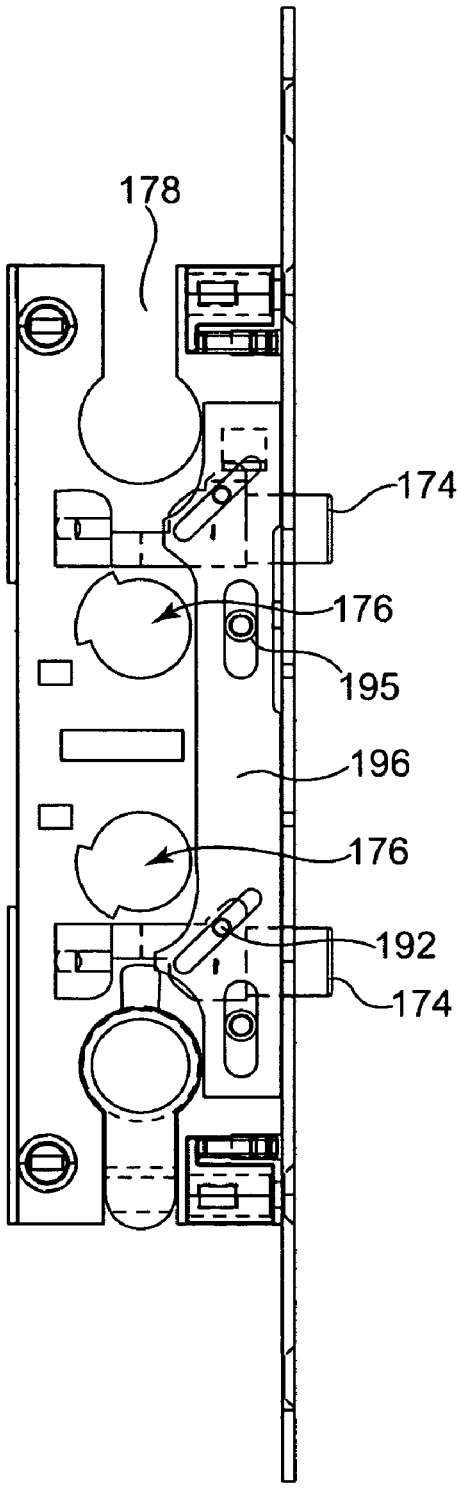
Figure 43:
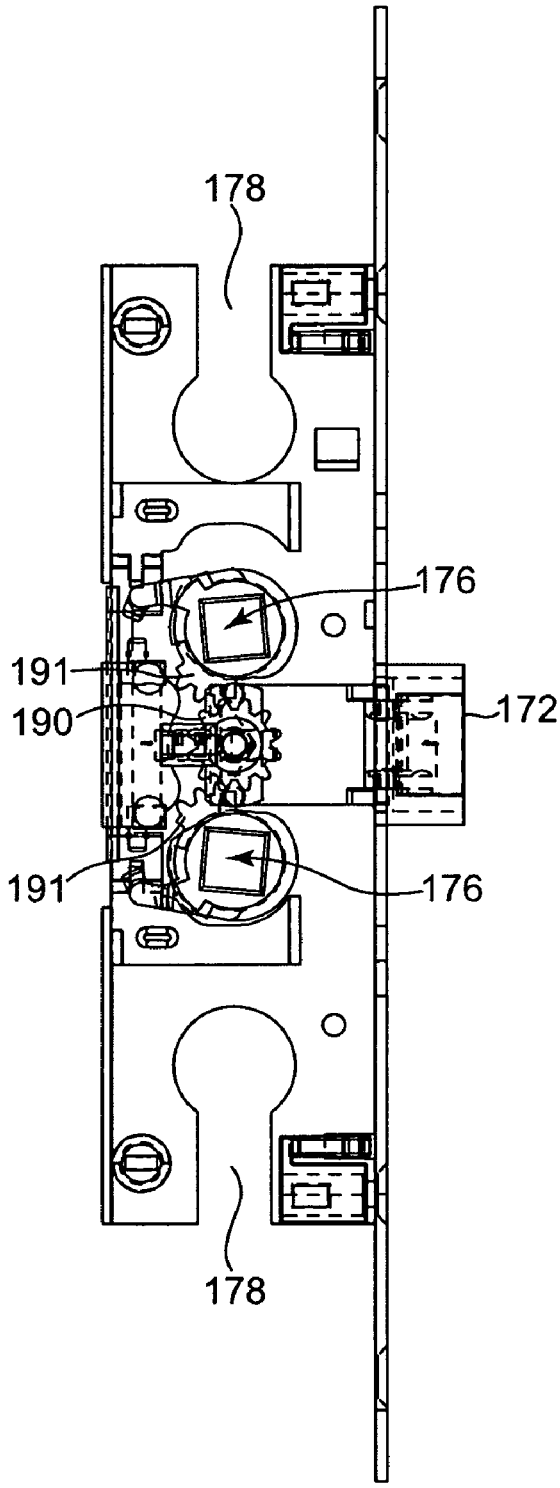
Figure 44:
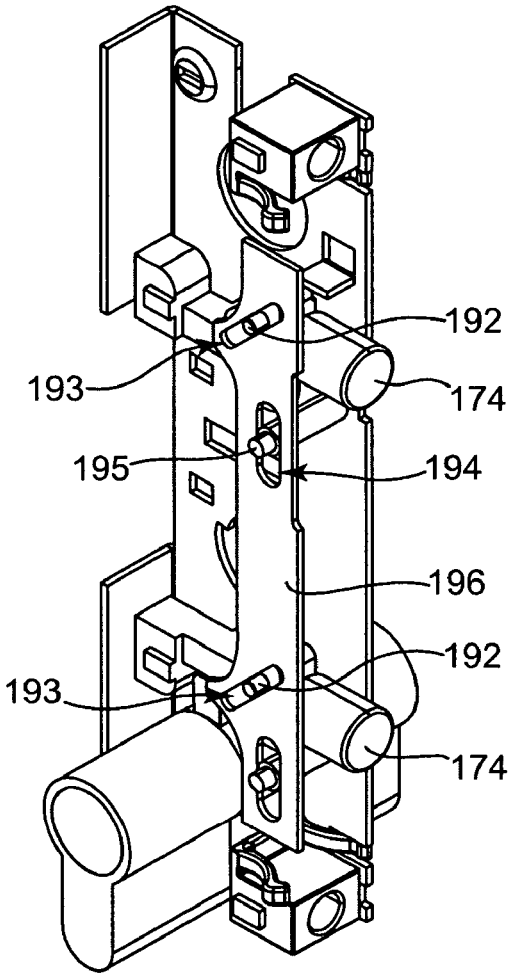
Figure 45:
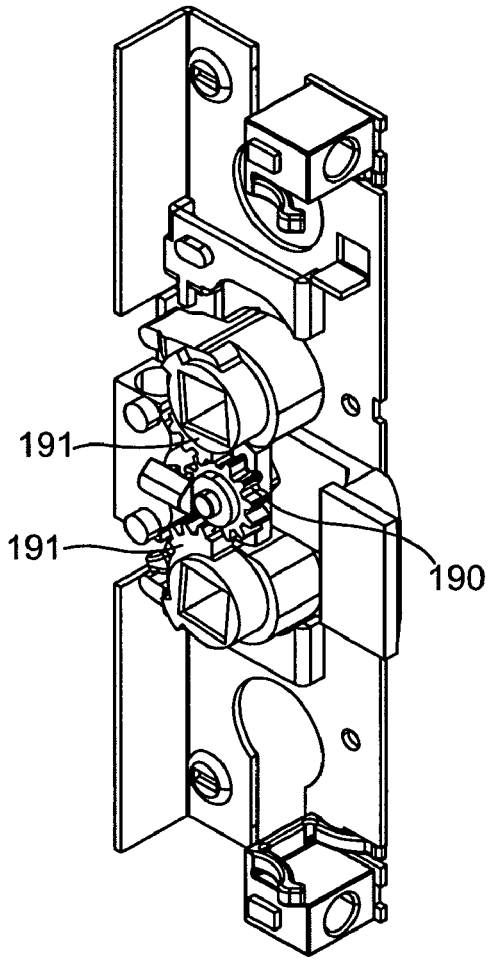
Figure 46:
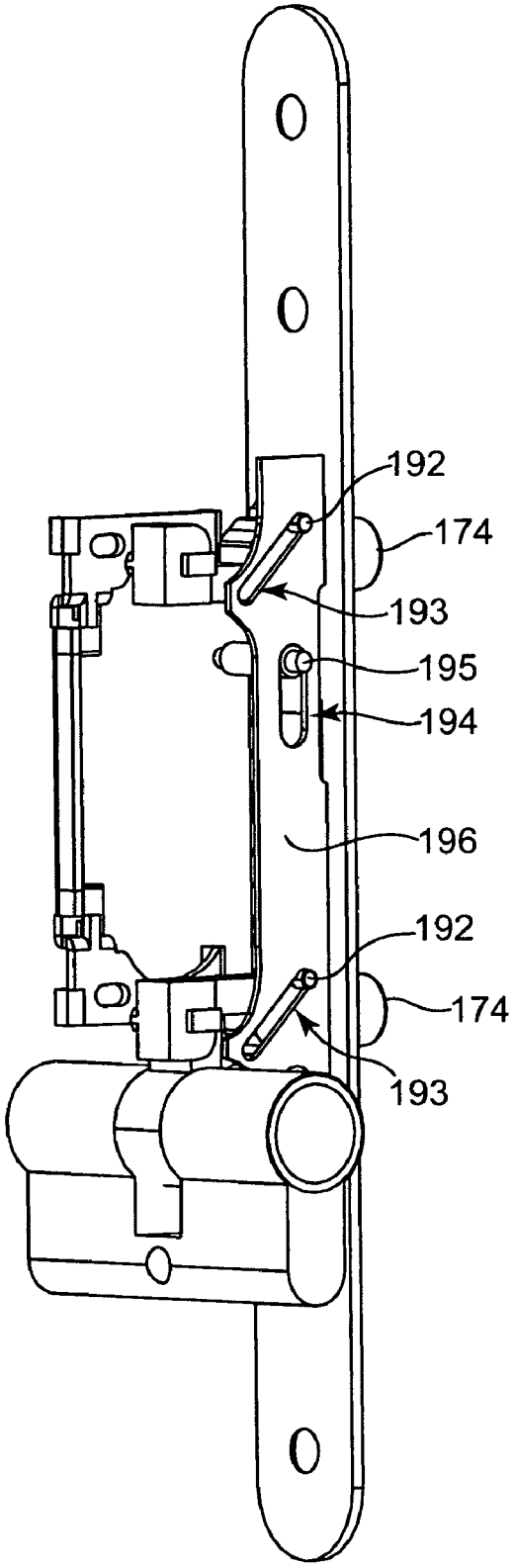

The lock assembly 80 may further include a trim plate 182 that may be secured to the latch z-bar 98. As illustrated in FIG. 35, the trim plate 182 may be affixed to the latch z-bar 98 and may be designed to correspond to receiving holes cut in the latch z-bar 98. The trim plate 182 may include a number of receiving holes for receiving the latch bolt 172 and the dead bolt 174 when they are in an extended position. As may be appreciated, depending on whether a right hinge or left hinge installation of the door system 50 is undertaken, portions of the upper and lower lockbody 158*a*, 158*b* will not be utilized.

The interior mechanism of the lock assembly 80 is illustrated in FIGS. 42-46. Each piece of the lock assembly 80 will not be individually labeled and described as one of skill in the art can recognize the connection and functionality of the pieces from the figures. The latch bolt 172 may be retracted and extended by operation of the handle 170, which interacts with a gear 190 and a gear 191. The gear 190 mates with gears 191 operably connected to the spindle receiving lumen 176 and moved by the spindle 166 whether the spindle 166 is placed in either spindle receiving lumen 176. When gear 191 is moved by the spindle 166 and spindle receiving lumen 176, the gear 190 retracts or extends the latch bolt 172. As may be appreciated, in many embodiments the latch bolt 172 may be biased towards the extended position.

In addition, both dead bolts 174 may be extended or retracted by action of key cylinder 160 no matter in which key cylinder receiving member 178 the key cylinder 160 is placed. The dead bolts 174 may extend and retract in unison by action of two slides 192 and a beam 196. When the key cylinder 160 is rotated by the thumb screw 181, for example, the nearest dead bolt 174 may be extended or retracted by direction action of the key cylinder 160. The extension or retraction of the dead bolt 174 causes the corresponding slide 192 to move in a track 193 in the beam 196. The movement of the slide 192 in the track 193 through which the slide 192 projects causes the beam 196 to move. When the beam 196 moves, the other slide 192 moves in a corresponding fashion, causing the other dead bolt 174 to also extend or retract. The beam 196 may be maintained in the proper vertical and horizontal planes by a slot 194 and a finger 195.

The glass pane 76 may be made of any type of glass, including safety glass, and may further include decorative patterns on or in the glass. Other glass that may be utilized may include stained glass or glass with decorative metallic caming. If a screen is included, the screen may be made of any suitable material known to those in the art, including metal, plastic, fiberglass or a combination of metal and plastic wire. The glass, screen, or glass and screen combination can be formed in a number of ways.

Installation of the Door System

As illustrated in FIG. 7, the installation of door system 50 may first begin by determining whether the door panel 66 will be installed utilizing a left hinge or a right hinge orientation. One of the features of the door system 50 is that the door panel 66 can be inserted easily in either orientation. The installer may choose the desired orientation.

Figure 2:
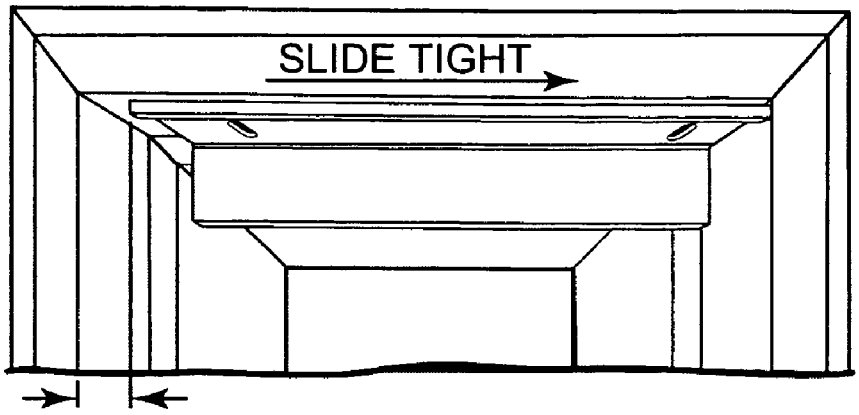
FIG. 2 illustrates installation checking the doorframe size before installation of the present invention door system.

Once the orientation is determined, the user may be required to shim the doorframe 56. Shimming the doorframe 56 may insure that the door panel 66 will be properly fitted to the doorframe 56 after installation. As illustrated in FIGS. 2-3, the header frame 70 may be placed along the top of the doorframe 56 and slid flush against one the vertical sides 62, 64. The gap (if any) between the header frame 70 and the other vertical side 62 or 64 of the doorframe 56 may then be measured. If the gap is less than about ¼" the installation may begin. If the gap is more than about ¼" the doorframe 56 should be shimmed so that the gap is no more than ¼".

Shims may be preferably one long piece, but may also be smaller sections, such as 8" or 12" sections. The shim may be secured to the doorframe 56 by nails or screws and should not extend beyond the doorframe 56 in an exterior direction. Once the doorframe 56 has been shimmed to the required width, the installation of the door panel 66 may proceed.

As illustrated in FIG. 5, the header frame 70 may first be centered along the top 58 of the doorframe 56. As illustrated in FIG. 6, the outer face of the header frame 70 may be aligned to a face of the brickmold during installation. The header frame 70 may be secured to the doorframe 56 by a number of screws. In one alternative embodiment, the header frame 70 may be attached to the ends of the hinge z-bar 96 and latch z-bar 98.

As illustrated in FIGS. 4 and 8, the door panel 66 may then be positioned on a relatively flat surface in the right hinge or left hinge orientation with an interior face pointing up. As provided to the installer, the door system 50 may include the glass pane 76 placed into position on the door panel 66. The glass pane 76 should be removed prior to installation by removing any shipping or restraining tabs.

After the glass pane 76 is removed from the door panel 66, the bottom expander 72 may be secured to the bottom side 92 of the door panel 66. The bottom spacer 120 may then be installed to the bottom expander 72 generally near to the hinge side of the bottom expander 72.

Figure 10:
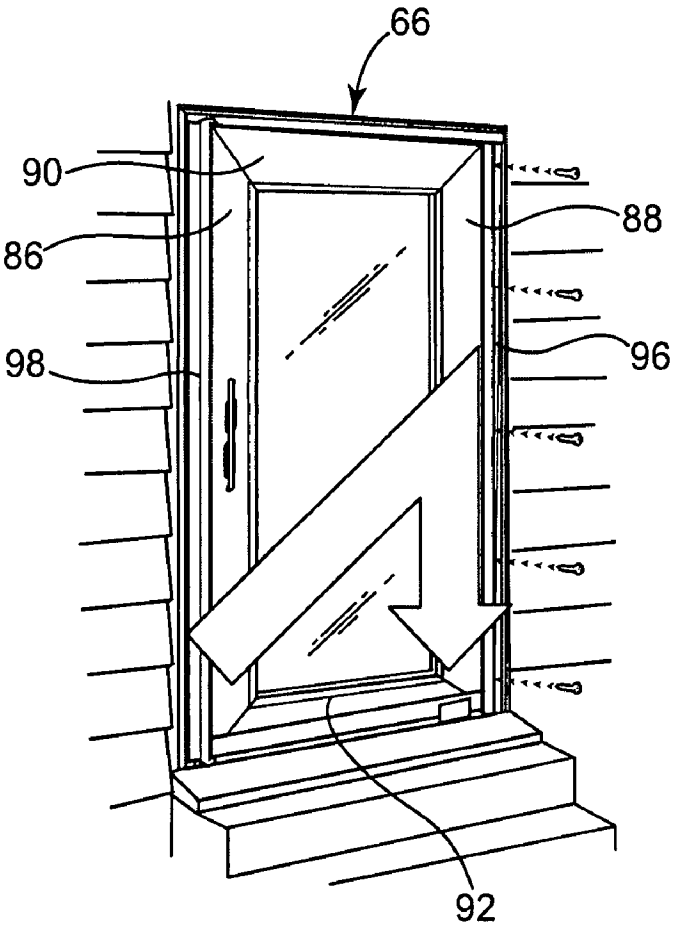

As illustrated, the screw receiving holes 180 in the bottom expander 72 may be substantially oval shaped. As will be further discussed in a later step, the oval holes 180 allow the bottom expander 72 to be moved some amount up or down relative to the door panel 66. Movement of the bottom expander 72 may allow the user to custom fit the overall height of the door panel 66 combined with the bottom expander 72 to closely fit the height of the doorframe 56. In other words, the bottom expander 72 may help to cover any gap, or a desired amount of gap, present between the bottom side 92 of the door panel 66 and the bottom 60 of the frame 56. As illustrated in FIG. 10, the door panel 66 may then be placed into the doorframe 56 by raising the door panel 66 up, sliding the door panel 66 so that the hinge z-bar 96 attached to the hinge side 88 of the door panel 66 meets the vertical hinge side 64 of the doorframe 56, and lowering the door panel 66 onto the bottom spacer 120.

Figure 11:
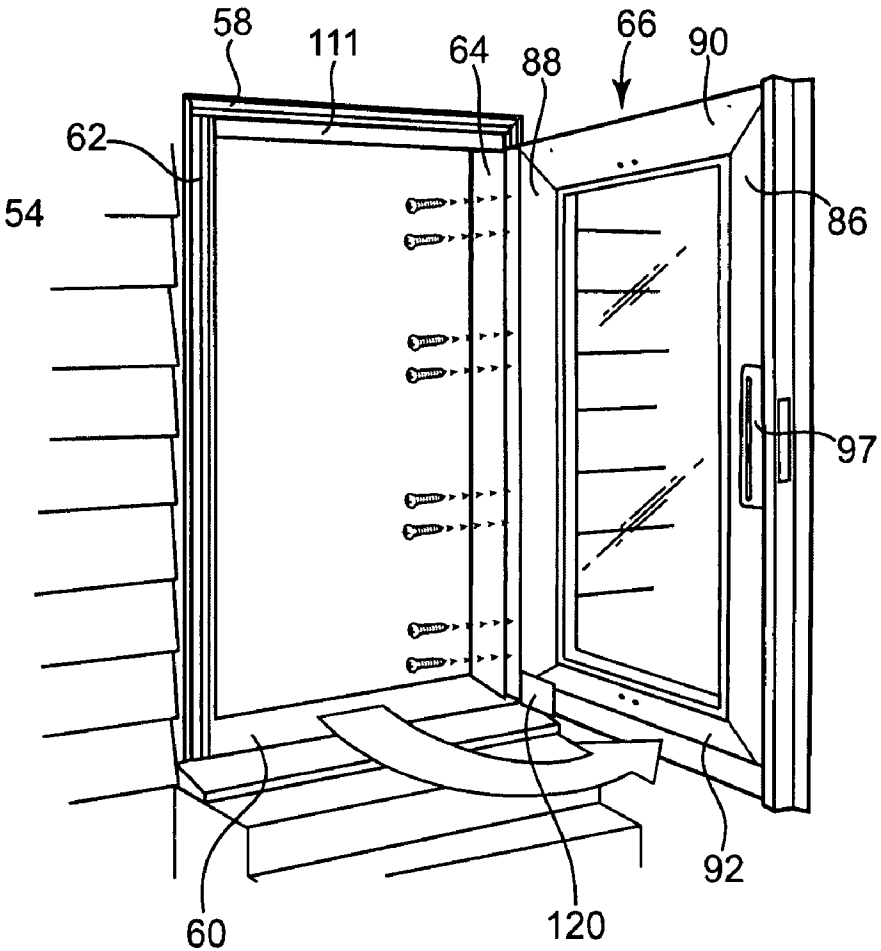
FIGS. 10-11 and 13 illustrate placement of the door panel in the doorframe during installation of the present invention door system.

While the door panel 66 is still in the closed position, pilot holes may be drilled into the doorframe 56 through factory drilled holes in the exterior facing portion of the hinge z-bar 96. Screws may then be inserted through the outside portion of the hinge z-bar 96 to secure the door panel 66 to the doorframe 56. As illustrated in FIG. 11, the door panel 66 and latch z-bar 98 may then be swung open revealing a number of factory drilled holes on the inside of the hinge z-bar 96 through which pilot holes may be made. The factory drilled holes may be in any pattern, but may preferably be near one or more hinge plates (not shown) that may be attached between the door panel 66 and the hinge z-bar 96. Screws may be inserted through the hinge z-bar 96 to secure the door panel 66 to the doorframe 56. The bottom spacer 120 is then removed.

In the next step of the door system 50 installation, the glass pane 76 (or screen) may be installed into the door panel 66. The present embodiment will be described in terms of installing a glass pane 76, but the installation of any type of glass and/or screen combination may be substantially the same. As shown in FIG. 12, from inside of the house 54 the glass pane 76 may be first placed into the door panel 66. The glass pane 76 may be of a size and shape such that it mates with an interior edge 184 of the door panel 66. The interior edge of the door panel 66 may run substantially along the latch side 86, hinge side 88, top side 90, and bottom side 92 of the door panel 66. The retainer strips may then be positioned to secure the glass pane 76 to the door panel 66. The present embodiment includes horizontal retaining strips 122*a* and vertical retaining strips 122*b*. The retainer strips 122*a* and 122*b* may be positioned so that the snap fitting of each retainer strip is received in a coupling present near the interior edge of the door panel 66. In the present embodiment the coupling may be a cavity into which the longitudinal snap fittings of the retainer strips 122*a* and 122*b* are engaged. The present door system 50 may be designed such that the horizontal retainer strips 122*a* are positioned first followed by the vertical retainer strips 122*b*.

Figure 13:
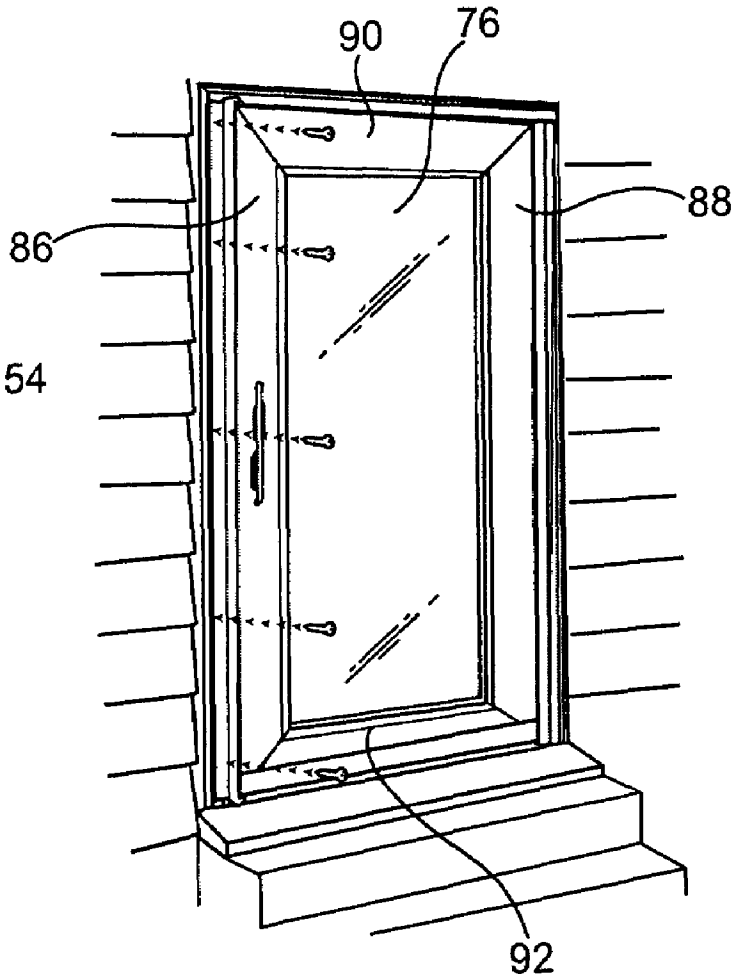
Figure 16:
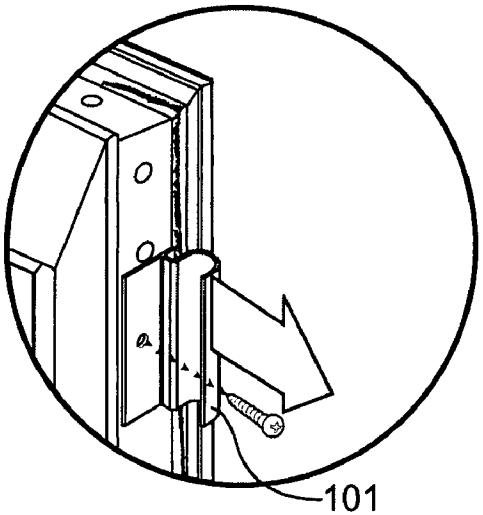

As illustrated in FIG. 13, screws may then be inserted through the latch side z-bar 98 and into the doorframe 56 to secure the latch z-bar 98 to the doorframe 56. Any shipping straps may then be cut. Cutting the straps may also release the shipping plate 97. As shown in FIG. 16, any clips or other materials that were removably securing the latch z-bar 98 to the door panel 66 may now be removed. The clips that secure the latch z-bar 98 to the latch side 86 of the door panel 66 may be removed. The screws that secured the clips to the door panel 66 may be reinserted into the door. The shipping plate 97 may remain affixed to the latch z-bar 98 until the lock assembly 80 is installed.

Figure 15B:
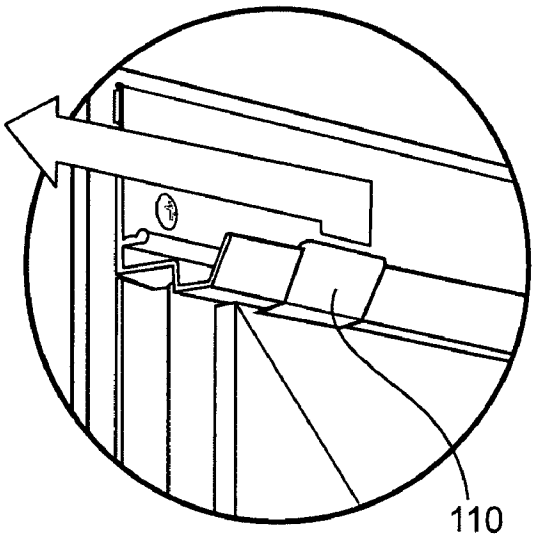
Figure 15A:
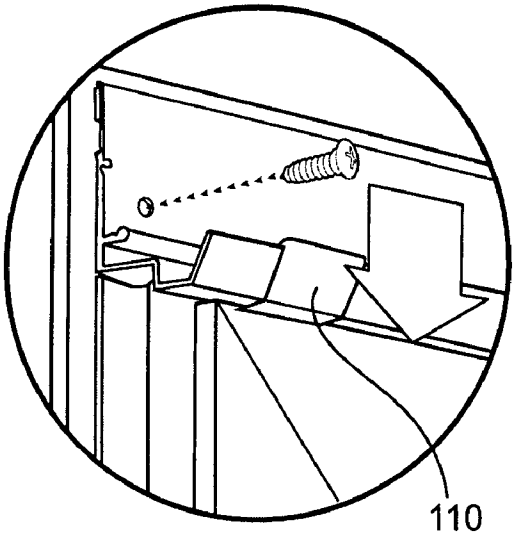
Figure 18:
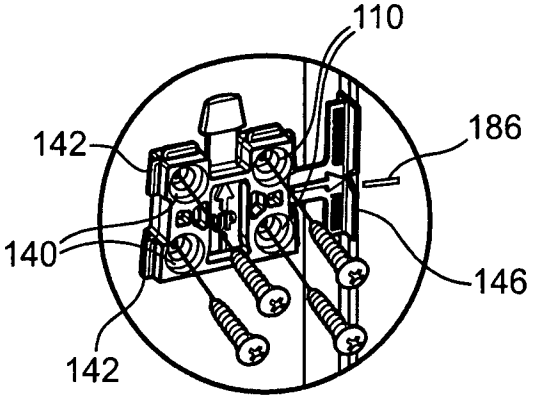
FIGS. 17-25 illustrate installation of the door closer assemblies of the present invention.
Figure 19:
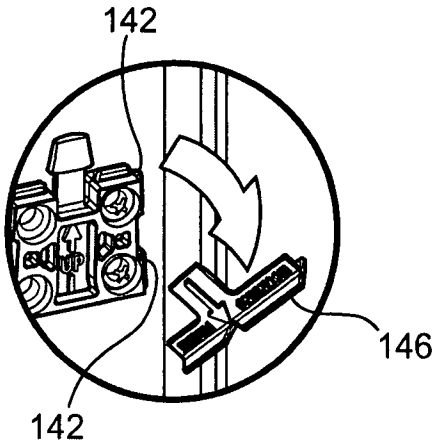

The next step for installing the door system 50 may include positioning and securing the top mounting frame 68. As illustrated in FIGS. 14, 15, and 15A, the top mounting frame 68 may be secured to the top side 90 of the doorframe 56. As illustrated, a portion of the vertical flange 104 may be first removed if it is determined that it will interfere with some portion of the doorframe 56, the siding, or other construct on the exterior side of the house 54. A portion of the vertical flange 104 may be removed by breaking the vertical flange 104 along a pre-scored line. An appropriate cutting tool may also cut the vertical flange 104. If the vertical flange 104 is removed, caulking may need to be placed between the top mounting frame 68 and the doorframe 56 or house 54 to insure a weather tight seal. Pilot holes may be drilled as necessary.

The top mounting frame 68 may be then positioned above the door panel 66 and in contact with the top side 58 of the doorframe 56. The door panel 66 may then be closed and the top mounting frame 68 may be lowered until the two factory-installed spacers 110 rest on a top edge of the top side 90 of the door panel 66. The factory installed spacers 110 may insure the correct spacing between the door panel 66 and the top mounting frame 68. Pre-drilled holes in the top mounting frame 68 may then be utilized to secure the top mounting frame 68 to the doorframe 56. The factory installed spacers 110 may be then removed.

As illustrated in FIGS. 32-37, the lock assembly 80 may now be installed. The lockbody 158 of the present invention may be installed in the door panel 66 at the factory. The lockbody 158 can be pre-installed in this manner because, as previously discussed, the lockbody 158 includes the elements of a door lock such that it can be used whether the door panel 66 is inserted in a left hinge or right hinge orientation. The lockbody 158 has duplicate lock structures so as to work whether the door panel 66 can be installed in the left hinge or right hinge format without having to adjust the position or orientation of the lockbody or change the angle on the face of the latchbolt 172 to allow the door to close properly. As may be appreciated, the door panel 66 is essentially rotated one way or the other depending on the selected orientation. The lockbody 158 therefore can be utilized regardless of the orientation of the door panel.

Viewing the lock assembly 80 in the right hinge format, the key cylinder 160, first handle 162, second handle 170, interior and exterior escutcheons 164 and 168, and spindle 166 may be assembled as illustrated. Other components, such as the illustrated washers, retaining clips, etc. may be utilized as illustrated to secure the pieces of the lock assembly together, but will not be separately described. While the lockbody 158 has novel features, the screws, washers, handles, etc. are well-known. The thumb latch 181 of the key cylinder 160 should be oriented to extend towards the interior of the house 54. The interior escutcheon 164 and the exterior escutcheon 168 may fit over the lockbody 158 and the cutouts 94 and may be secured by placing a screw other securing means from an interior side of the house 54 so as to secure the two escutcheons 164 and 168 together. In the present embodiment, activation of the thumb latch 181 engages both of the dead bolts 174.

The handles 162 and 170 and spindle 166 may be secured and tightened utilizing a hex key, but any other type of screw member or tightening member may be utilized. As illustrated best in FIG. 34, the installed lock assembly 80 includes the latch bolt 172 and the dead bolt 174 in positions to be operated by the first or second handles 162 and 170 and the key cylinder 160, respectively. As illustrated in FIG. 35, the shipping plate 97 may now be removed from the latch z-bar 98 and discarded. The trim plate 182 may be installed and, if necessary, adjusted to receive the latch bolt 172 and the dead bolt 174. Moreover, the latch bolt 172 may or may not lock into an extended position, i.e., in various embodiments the latch bolt 172 may or may not be locking.

Figure 17:
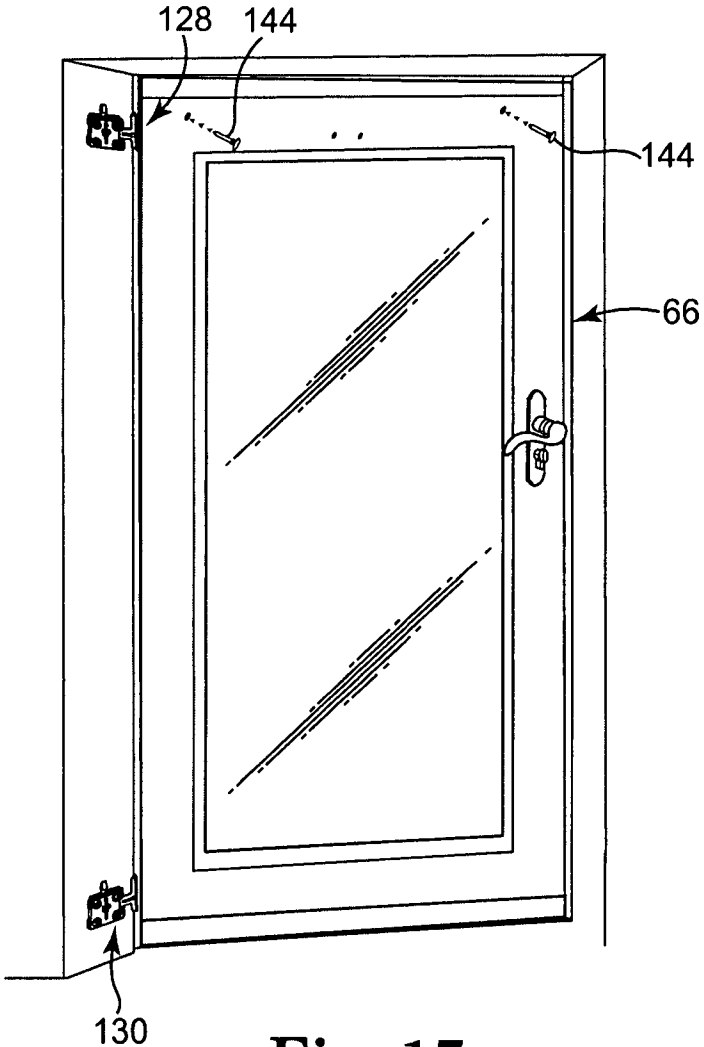
Figure 21:
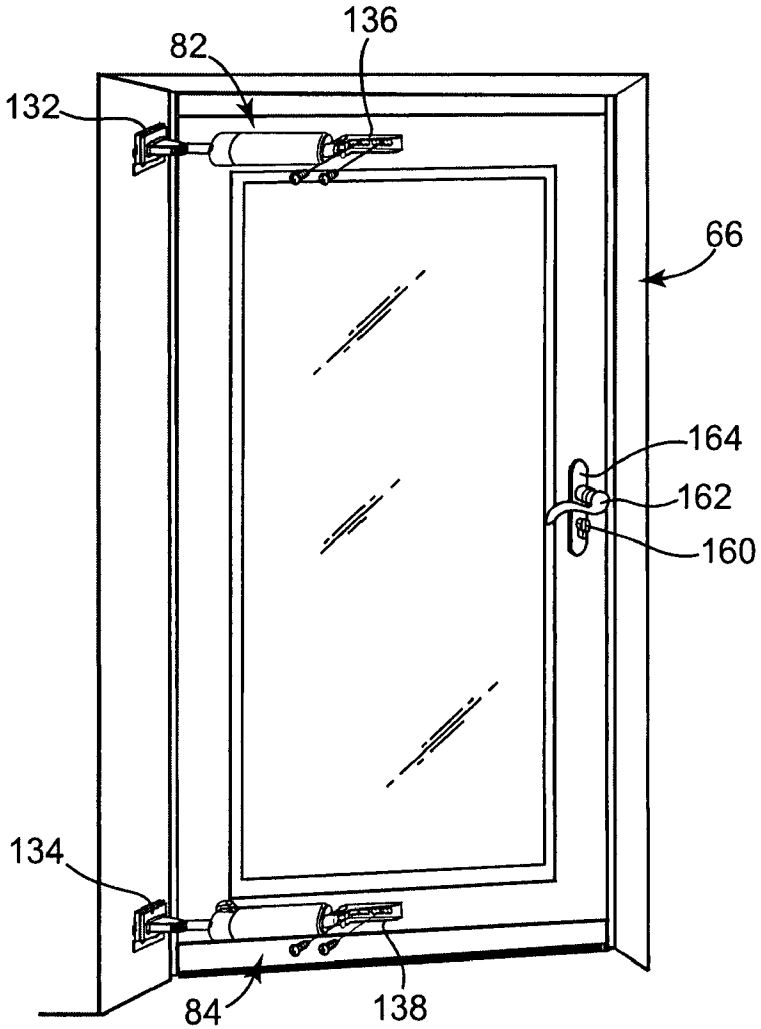
Figure 20:
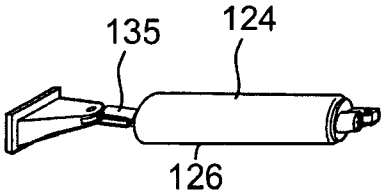
Figure 24:
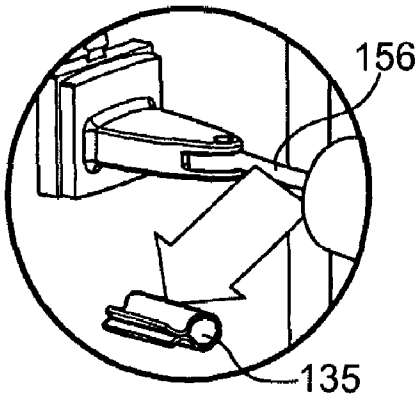
Figure 25:
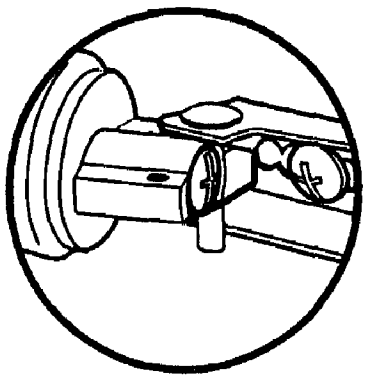
Figure 23:
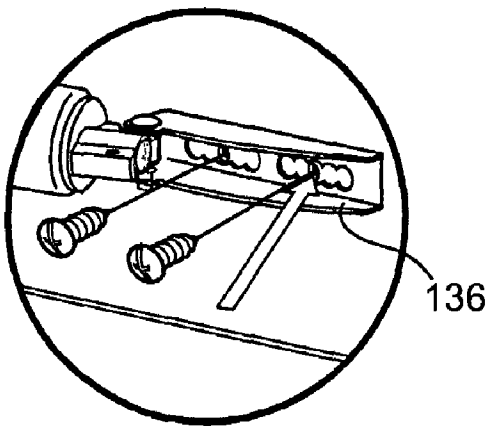
Figure 22:
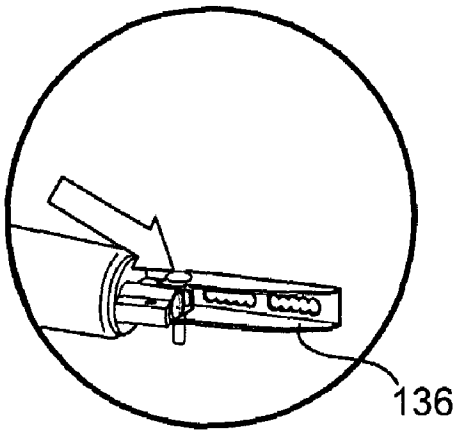

As illustrated in FIGS. 16-25, the top and bottom closer assemblies 82, 84 may now be fixed into position. In the present embodiment, the top and bottom jamb bracket bases 128, 130 include hole plugs 144 removably affixed thereto. These hole plugs 144 may be removed and inserted into unused screw holes in the door panel 66 as shown in FIG. 17. The top side 90 of the door panel 66 may have unused screw holes because the bottom expander 72 is installed on the bottom side 92 of the door panel 66 in the selected right hinge format, while it would be attached to (what is now) the top side 90 in the left hinge format. Moreover, in different embodiments, the hole plugs 144 may be included with any portion of the door system 50, or may be provided as individual components.

The top and bottom jamb bracket bases 128, 130 may be aligned on an interior side of the house 54. The jamb bracket bases 128, 130 may include breakaway alignment tabs 146. The alignment tabs 146 may include arrows or other indicators that can be aligned with one or more notches 186 factory installed in the storm door, door panel, or hinge z-bar 96 to insure the proper horizontal and vertical placement of the door closer assemblies 82, 84. The notches 186 in the hinge z-bar 96 may be any kind of notch, hole, marking, or removable indicator, such as a sticker.

The same jamb bracket bases 128, 130 may be utilized whether the door panel 66 is mounted in a right hinge or a left hinge format. The "up" orientation indicator and the alignment tab 146 may be printed on both sides of the jamb bracket bases 128, 130 so as to indicate the correct alignment. Once the jamb bracket bases 128, 130 are correctly positioned, the screw insertion points may be utilized to drill pilot holes to the doorframe 56 or interior wall where the jamb bracket bases 128, 130 will be secured. Once screws are inserted to fix the jamb bracket bases 128, 130 in place, the alignment tabs 146 may be removed. The jamb brackets 132, 134 may then be slid over the jamb bracket bases 128, 130 and secured into position. In the present embodiment the jamb brackets 132, 134 may be already pivotally connected to the door closers 124, 126. The door brackets 136, 138 may then be operatively secured to the door closers 124, 126 and to the door panel 66 with screws. In alternative embodiments, the door brackets 136, 138 may be installed to the door panel 66 at the factory. As illustrated, the door brackets 136, 138 have a number of different shaped screw retention points for securing the door closers 124, 126 to the door panel 66. The symmetric design of the top and bottom door closer assemblies 82, 84 and the ability to vertically and horizontally locate the proper position to place the same without additional measuring steps may contribute to the quick installation of the door system 50. Moreover, the predetermined installation length of the door closer 124, 126 allows the same to be connected to the door panel 66 at the proper length to insure the proper tension. The clips 135 may then be removed from the shafts of the door closers 124, 126.

In the next step of installing the door system 50, the position of the bottom expander 72 relative to the door panel 66 may be adjusted. As illustrated in FIGS. 8 and 26, the screws connecting the bottom expander 72 to the bottom side 92 of the door panel 66 may first be loosened (but not removed). Because of the oval shape of the screw receiving holes in the door expander 72, the door expander 72 can be shifted up or down such that the sweeps 112 lightly contact the bottom side 60 of the doorframe 56 (or any sill present) and do not bind when the door panel 66 is opened and closed. The screw cover strips 74*a*, 74*b* may then be snap fitted into place over the exterior screws in the latch and hinge z-bars 98, 96.

If any remaining glass elements need to be installed, they may be installed as the last step.

It will be apparent from the foregoing description that is provided a simplified storm door 52 kit and a method for installing the same whereby a single kit may be utilized by a home owner with minimum skill to provide a door which may be hingedly mounted in a left or right hinge format and installed with a reduced amount of time and effort.

With regard to the foregoing description, it is to be understood that changes may be made in the details, without departing from the scope of the present invention. It is intended that the specification and depicted aspects be considered exemplary only, with a true scope and spirit of the invention being indicated by the broad meaning of the following claims.

What is claimed is:

1. A method for installing a door into a doorframe having a top and a bottom, the method comprising:

providing a door assembly including a door panel with an external surface, a lock assembly mounted in the door panel and having a mortise lockbody with duplicate lock hardware located symmetrically about a horizontal axis, the lockbody further comprising dual dead bolts, a hinge z-bar, and a latch z-bar, the hinge z-bar pivotally mounted to a first side of the door panel and the latch z-bar removably secured to a second side of the door panel;

orienting the door assembly by rotating the door panel, lock assembly, hinge z-bar and latch z-bar together for either a right hinge or a left hinge operation;

attaching a bottom expander to a bottom side of the door panel, the bottom expander attachable in a selected position on the door panel setting the door assembly in the doorframe and securing the hinge z-bar and the latch z-bar to the doorframe and releasing the latch z-bar from the second side of the door panel such that the door panel is free to swing between a closed position and an open position;

securing a header frame to the top of the doorframe;

securing a top mounting frame to the top of the doorframe, the top mounting frame extending above the door panel inserting a key cylinder into one of two symmetrical key cylinder receiving members on the mortise lockbody mounted in the door panel, and operating the key cylinder to extend both dead bolts in coordination;

aligning one or more jamb bracket bases onto the doorframe in a desired position by matching a guide indicia on the jamb bracket base to the hinge z-bar;

mounting one or more closers to each jamb bracket base and attaching the closers to the door panel, the closers being of variable length but releasably secured at an installation length;

releasing the one or more closers; and adjusting the position of the bottom expander relative to the doorframe to lightly contact the bottom side of the doorframe.

2. The method of claim 1 further comprising inserting a handle spindle into a one of a pair of spindle receiving lumens in the mortise lockbody mounted in the door panel and attaching handles to the handle spindle.

3. The method of claim 1, wherein the hinge and latch z-bars are fixedly secured to the doorframe.

4. The method of claim 1, wherein the door panel and the header frame and the top mounting frame forms a seal with the top of the doorframe when the door panel is in the closed position.

5. The method of claim 1, wherein the door panel and the bottom expander forms a seal with the bottom of the doorframe when the door panel is in the closed position.

6. The method of claim 1 further including removably securing a top spacer to the top mounting frame to position the top mounting frame relative to the door panel.

7. The method of claim 6 further comprising removing the top spacer from the top mounting frame after installation of the top mounting frame.

8. The method of claim 1 further including removably securing a bottom spacer to the bottom expander to position the door panel and bottom expander relative to the bottom of the doorframe.

9. The method of claim 8 further comprising removing the bottom spacer from the bottom expander after positioning the door panel and bottom expander.

10. The method of claim 1 wherein the step of securing a header frame to the top of the doorframe includes covering a gap between the door panel and the top of the doorframe.

* * * * *

UNITED STATES PATENT AND TRADEMARK OFFICE

CERTIFICATE OF CORRECTION

PATENT NO. : 7,661,226 B2
APPLICATION NO. : 11/215294
DATED : February 16, 2010
INVENTOR(S) : Kibbel et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1008 days.

Signed and Sealed this

Thirtieth Day of November, 2010

David J. Kappos

David J. Kappos
*Director of the United States Patent and Trademark Office*